US005787534A

United States Patent [19]

Hargest et al.

[11] Patent Number: 5,787,534

[45] Date of Patent: Aug. 4, 1998

[54] SUDDEN INFANT DEATH SYNDROME PREVENTION APPARATUS AND METHOD AND PATIENT SURFACE

[76] Inventors: Thomas S. Hargest, 14 Lockwood Blvd., Apartment 10J, Charleston, S.C. 29401; William M. Hargest, 1321 E. Vagabond La., Mt. Pleasant, S.C. 29464

[21] Appl. No.: 475,009

[22] Filed: Jun. 7, 1995

Related U.S. Application Data

[63] Continuation-in-part of Ser. No. 237,146, May 3, 1994, Pat. No. 5,483,711, which is a continuation of Ser. No. 899,462, Jun. 16, 1992, Pat. No. 5,317,767.

[51] Int. Cl.[6] ..... A47C 21/04; A47D 7/00

[52] U.S. Cl. ..... 5/726; 5/423; 5/652.2; 297/180.11

[58] Field of Search ..... 5/423, 468, 469, 5/655, 461, 453, 482, 284, 481, 726, 652.2, 714; 297/180.13, 180.11; 128/202.18, 205.26

[56] References Cited

U.S. PATENT DOCUMENTS

| | | | |
|---|---|---|---|
| 2,025,659 | 12/1935 | Gilquin | 5/639 |
| 2,400,790 | 5/1946 | Tolen | 5/469 |
| 2,493,067 | 1/1950 | Goldsmith | 5/423 |
| 2,815,516 | 12/1957 | Holton | 5/461 |
| 3,135,974 | 6/1964 | Roman | 5/461 |
| 3,486,177 | 12/1969 | Marshack | 5/423 |
| 3,529,310 | 9/1970 | Olmo | 5/423 |
| 3,644,950 | 2/1972 | Lindsay, Jr. | 5/469 |
| 3,757,366 | 9/1973 | Sacher | 5/423 |
| 3,778,851 | 12/1973 | Howorth | 5/423 |

(List continued on next page.)

FOREIGN PATENT DOCUMENTS

| | | | |
|---|---|---|---|
| 2399824 | 9/1979 | France | 5/655 |
| 1035073 | 7/1966 | United Kingdom | 5/468 |
| 1391506 | 4/1975 | United Kingdom | 5/468 |
| 1574888 | 9/1980 | United Kingdom | 5/726 |
| 2065465 | 7/1981 | United Kingdom | 5/423 |
| 2198940 | 6/1988 | United Kingdom | 5/468 |

OTHER PUBLICATIONS

Raloff, J., Do Some Sids Vitamins Actuall Suffocate, pp. 403, 405; Jun. 29, 1991; Science News—The Weekly News Magazine of Science.

Gilbert–Barness, et al., Hazards of Mattresses, Beds, and Bedding in Deaths of Infants, pp. 27–32; The American Journal of Forensic Medicine and Pathology; vol. 12, #1, 1991.

(List continued on next page.)

*Primary Examiner*—Alexander Grosz

*Attorney, Agent, or Firm*—Dority & Manning, PA

[57] ABSTRACT

A safety pad or mattress such as for use in a crib prevents sudden infant death syndrome by ensuring an oxygenated breathing space for the infant. Reticulated foam is made into a pad or a mattress and may be covered with a fitted open weave fabric covering. An embedded air tube is interconnected with an air pump which circulates fresh, i.e., oxygenated, air in the breathing space. The air pump may be inside or outside the mattress. The forced air circulation flushes any exhaled carbon dioxide from the breathing space, even when the infant is face down or otherwise in a prone position on the mattress, to prevent carbon dioxide poisoning. The air circulation flow rate is limited to prevent infant cooling. A pad bladder for similar function may be provided having a layer of reticulated foam sandwiched between upper and lower air impervious sheets and dispersing air introduced therebetween. The upper sheet has a pattern of air holes for release of the dispersed air. Two or more zones with different air flow rates may be established with different air hole patterns, so that a higher risk infant can receive a relatively higher air flow rate. A patient care surface uses a low air loss bladder with a sandwiched layer of reticulated foam as an air dispersing element and a still higher air flow rate for intentionally cooling and drying a patient, which aids the skin and other general condition of the patient.

109 Claims, 9 Drawing Sheets

U.S. PATENT DOCUMENTS

| | | | |
|---|---|---|---|
| 4,536,906 | 8/1985 | Varndell et al. | 5/468 |
| 4,620,337 | 11/1986 | Williams et al. | 5/481 |
| 4,686,724 | 8/1987 | Bedford | 5/481 |
| 4,768,251 | 9/1988 | Baskent | 5/481 |
| 4,898,164 | 2/1990 | Baumberg | 128/202.18 |
| 4,984,316 | 1/1991 | Simpson et al. | 5/423 |
| 5,305,483 | 4/1994 | Watkins | 5/645 |
| 5,317,767 | 6/1994 | Hargest et al. | 5/655 |
| 5,325,551 | 7/1994 | Tappel et al. | 5/469 |
| 5,336,250 | 8/1994 | Augustine | 5/423 |
| 5,343,579 | 9/1994 | Dickerhoff et al. | 5/421 |
| 5,367,728 | 11/1994 | Chang | 5/615 |

OTHER PUBLICATIONS

Dwyer et al., "Prospective Cohort Study of Prone Sleeping Position and Sudden Infant Death Syndrome," pp. 1244–1247, May 25, 1991, The Lancet, vol. 337.

Christian Gorman, "Beware of the Pillow," p. 48, Jul. 8, 1991, Time Magazine.

Kemp et al., "Sudden Death in Infants Sleeping on Polystyrene–Filled Cushions," pp. 1858–1864, Jun. 27, 1991, The New England Journal of Medicine.

SUDDEN INFANT DEATH SYNDROME PREVENTION APPARATUS AND METHOD AND PATIENT SURFACE

This application is a continuation-in-part of U.S. Ser. No. 08/237,146 filed May 3, 1994, now U.S. Pat. No. 5,483,711 which is a continuation of U.S. Ser. No. 07/899,462 filed Jun. 16, 1992, and now issued as U.S. Pat. No. 5,317,767.

BACKGROUND OF THE INVENTION

The present invention relates in general to apparatus and method for the prevention of sudden infant death syndrome and in particular to an infant safety pad or mattress and corresponding method for the prevention of infant asphyxiation from carbon dioxide poisoning. Further present aspects relate to improved patient care generally, including cooling and drying of patient skin.

Several thousand apparently healthy infants (children under the age of 1 year) die each year in the United States from Sudden Infant Death Syndrome (SIDS). Deaths from SIDS have been estimated at 7,000 to 10,000 per year. See for example *Womens Day*, volume 55, issue 3, Jan. 7, 1992, pages 38 through 43; and *USA Today*, volume 117, issue 2525, February 1989, page 11. The occurrence of SIDS in a given family can be particularly devastating emotionally because, in general, there is no warning that the infant is at risk and the parent or care giver has no knowledge of any problem until he or she discovers an unconscious or deceased infant thought to be safely sleeping in its crib.

The specific cause of SIDS is generally unknown, which unfortunately leads to the result that heretofore there has generally been no known treatment and generally no means of prevention.

While no specific cause or causes of the medical disaster are known, the medical community has produced several different theories. One such theory is that the victim infant suffers from some form of neurological disorder (cause unknown and existence undetected). The disorder operates to interrupt the infant's breathing (sometimes referred to as the infant simply "forgetting" to breath) and death results due to suffocation.

Another theory also suspects infant suffocation, but not due to any neurological disorder interrupting breathing. Instead, it is believed that the infant becomes fatally poisoned by exhaled carbon dioxide which has become trapped or accumulated and then rebreathed by the infant. The theoretical possibility of SIDS death caused by the rebreathing of expired gases, oxygen deficient air, and/or by blocked air passages in bedding has been discussed in the medical and other literature. See for example *The Lancet*, volume 337, issue 7852, May 25, 1991, pages 1244 through 1257; *The Journal of the American Medical Association*, volume 263, issue 21, Jun. 6, 1990, pages 2865 through 2869; *The New England Journal of Medicine*, volume 324, issue 26, Jun. 27, 1991, pages 1858 through 1864; and *Time*, volume 138, issue 1, Jul. 8, 1991, page 48.

The reason that carbon dioxide poisoning from rebreathing of exhaled gases is suspected is because heretofore the conventional wisdom (i.e., the prevailing advice) has been for small infants to be placed on their stomachs (i.e., a prone position) for best rest and sleep. The reason for this is well known to any parent or care giver; a young infant will frequently regurgitate (i.e., spit up) previously ingested fluids and sometimes become choked by reswallowing the matter. This is a very natural and relatively frequent occurrence, and entirely different from vomiting due to any illness, because the digestive system of the infant at birth and for a time period thereafter is generally inadequately developed so as to consistently retain fluids. Such regurgitation often accompanies burping or hiccups.

If an infant were to be placed on its back (i.e., a supine position) so as to keep its face open and unblocked for safe breathing, there is a recognized and significant risk of aspiration from simple regurgitation of fluids. Aspiration (i.e., taking foreign matter into the lungs during breathing) can result in fatal choking. Matter regurgitated by an infant in a supine position would frequently be retained by gravity in the infant's mouth and potentially reswallowed (aspirated) during breathing. Therefore, to prevent this possibility, infants have been traditionally placed prone or face down for rest or sleep.

The size and weight of a newborn infant's head is relatively large in relation to the remaining body of the infant, and particularly in relation to the initial strength of the infant. Oftentimes a newborn infant is not even able to raise its head adequately so as to turn from one check to another, or to simply raise its face from against the bedding which it rests. Adequate strength for such movements develops relatively quickly, but still may take several weeks or more. Even so, an infant can tire quickly from simply trying to raise its head. At such resting times, and from other movements, an infant may place its own face straight down onto a crib mattress and into the bedding materials, despite any resulting blockage of air passages.

All of the foregoing leads to the situation that even newborn infants are typically placed (at least initially) in a relative prone position (with their head typically turned to one side) for rest or sleep.

A typical conventional crib mattress for supporting an infant takes the form of some resilient or softened pad either relatively impermeable to air, or more often covered with a solid vinyl or plastic permanent covering so as to give form and shape to the mattress and particularly so as to prevent the mattress inner portion from becoming wet from infant regurgitation or other discharges. In other words, a vinyl mattress cover is readily cleaned if there is any spit up or diaper leakage from the infant.

At the same time, due to its relatively uncomfortable vinyl cover, the conventional crib mattress is often further covered with a cloth pad, sheet, baby quilt, or the like, all of which may be relatively loose fitting. In addition, a light blanket or similar object may be used to cover a portion of the infant for warmth. Still further, an infant or young child may have a cloth diaper or similar small blanket which it clutches or grasps in its hands and draws close to it, sometimes close to its face as it snuggles against such blanket or even against the mattress on which it rests.

The foregoing arrangement can result in a combination of materials from which a fragile but not unhealthy baby may be unable to become untangled (if entanglement occurs). As the accident events progress and an infant begins to rebreath the carbon dioxide which it exhales, it becomes weaker to the point of collapsing face down into the bedding mattress. It then continues to rebreath the exhaled carbon dioxide to the point of becoming unconscious, and the infant medically deteriorates from that point to the point of death.

The likelihood of carbon dioxide poisoning as a cause or major factor in SIDS has been regarded as so great and the certain results therefrom are so catastrophic that some pediatricians have recently begun recommending for the first time that infants be placed on their backs for sleeping (i.e., in a supine position). In other words, the previously recognized risk of aspiration from regurgitation by an infant sleeping on its back is believed by some as outweighed by the risk of asphyxiation from carbon dioxide poisoning by an infant sleeping in a prone position.

In the medical care field, it has heretofore been practiced to provide known sick or at risk patients "oxygen therapy." Where a patient has a particular respiratory condition or other demanding condition, pure oxygen or air with an enriched percentage of oxygen may be given to patients such as through either a mask applied to the patient's face or through a tent enclosing the head or upper body portion of the patient. Neonatal anesthesia masks exist but have not generally been used for an infant or small child who was not undergoing some specific therapy or which was not under some specific medical care.

Air circulation in a specific sense has heretofore been practiced in conjunction with certain mattress technology for the intended purpose of preventing and/or treating decubitus ulcers. Ulcerated areas of the skin or bed sores can occur from prolonged or excessive pressure to a specific body point during bed rest, and/or from trapped heat and perspiration. These conditions can be treated and/or prevented by the circulation of air in the vicinity of affected areas. Potentially affected areas typically include bony prominences, for example, such as at the patient's hips, knees, and ankle joints.

Bedford (U.S. Pat. No. 4,686,724) discloses air channels 19 through an open cell foam pad for the intended purpose of preventing decubitus ulcers. Plugs 21 and 22 may be removed from channels 19 in certain areas of the pad body for the creation of air channels in the corresponding area. Williams et al. (U.S. Pat. No. 4,620,337) discloses (column 1, lines 40 through 51) the use of inflatable cells which are alternately inflated and deflated (called alternating pressure pads) for preventing the formation of decubitus ulcers. In column 5, lines 10 through 15, the patent also refers to the use of rib design in the mattress for promoting air circulation between the pad and the patient to disperse body heat and reduce moisture build-up, both related to the formation of decubitus ulcers, and for promoting increased air flow through open cells of the foam pad. Baskent (U.S. Pat. No. 4,768,251) discloses in column 3, lines 4 through 55, the idea of using alternating peaks and valleys to form convolutions which allow air to pass around the peaks thereof through such valleys, again for the purpose of preventing the formation of decubitus ulcers.

SUMMARY OF THE INVENTION

The present invention recognizes and addresses such problems and others arising from Sudden Infant Death Syndrome. Thus, broadly speaking, a principal object of this invention is the prevention of Sudden Infant Death Syndrome. More particularly, a main concern is improved apparatus and method for an infant safety pad or mattress for the prevention of infant asphyxiation, such as from carbon dioxide poisoning.

Another present main concern is improvement generally in the area of patient skin condition management.

It is another particular object of the present invention to provide a new form of crib safety apparatus and method for the prevention of SIDS due to carbon dioxide poisoning. More specifically, it is a present object to provide a crib safety pad or mattress for infants which permits elimination of potential contributing factors to carbon dioxide poisoning such as loose bed sheets and impervious pads or mattresses beneath the sheets which preclude air flow therethrough.

It is another general object of the present invention to provide apparatus and method which establishes a safety breathing space beneath a support surface of a pad or mattress and circulates fresh (i.e., oxygenated) air in such space so as to flush and prevent potentially dangerous accumulations of carbon dioxide in such space.

Still another present object is to provide improved apparatus and method which eliminates the potential problem of infant rebreathing of exhaled gases, such as carbon dioxide, to reduce and hopefully eliminate the incidence of SIDS. It is a further object to permit resting or sleeping infants to once again be safely placed in a prone position, but without risk of carbon dioxide poisoning, so as to reduce the risk of aspiration from regurgitation of fluids.

Another present object is to provide method and apparatus for the prevention of SIDS so as to not only eliminate the accidental deaths of the victim infants, but so as to eliminate the traumatic and perhaps devastating effects on family members and other care givers of the accidental victims.

Additional objects and advantages of the invention are set forth in, or will be apparent to those of ordinary skill in the art from, the detailed description which follows. Also, it should be appreciated further that modifications and variations to the specifically illustrated and discussed features, materials, or steps hereof may be practiced in various embodiments and uses of this invention without departing from the spirit and scope thereof, by virtue of present reference thereto. Such variations may include, but are not limited substitution of equivalent means, features, materials, or steps for those shown or discussed, and the functional or positional reversal of various parts, features, steps, or the like.

Still further, it is to be understood that different embodiments, as well as different presently preferred embodiments, of this invention may include various combinations or configurations of presently disclosed features, elements, or steps, or their equivalents (including combinations of features or steps or configurations thereof not expressly shown in the figures or stated in the detailed description).

One exemplary such embodiment of the present invention relates to an infant safety device for the prevention of infant asphyxiation. Such safety device comprises the combination of a particular support pad with forced air circulation means in accordance with the invention. The support pad preferably has an upper support surface and is comprised of air permeable material therebeneath so that a breathing space is created below an infant received on such upper support surface. The forced air circulation means are operative for circulating oxygenated air through the breathing space so that carbon dioxide exhaled by an infant received on the upper support surface is flushed from such breathing space so as to prevent asphyxiation of the infant due to carbon dioxide poisoning.

In such exemplary embodiment, the air permeable material preferably comprises reticulated foam having about 30 pores per inch or less to provide an unblocked passage for oxygen and carbon dioxide gasses in the vertical and horizontal directions both to and from the infant. Also, the forced air circulation means preferably has a maximum output of about 2000 milliliters per minute for adequate volume flow to supplied oxygenated air and flush exhaled carbon dioxide without causing excessive cooling to the infant.

Another present exemplary embodiment concerns an infant safety device for the prevention of infant asphyxiation. Such safety device preferably includes a support pad and forced air circulation means. The support pad has an upper support surface formed by a first layer comprised of air permeable material, and a predetermined non-blockable supplemental air dispenser therebeneath. With such an arrangement, a predetermined breathing space is created below an infant received on the upper support surface.

The forced air circulation means is operative for circulating oxygenated air through such breathing space via the air dispenser so that carbon dioxide exhaled by an infant received on the upper support surface is flushed from the breathing space while oxygenated air for inhaling by such infant is provided to the breathing space. Such arrangement simultaneously prevents asphyxiation of the infant due to carbon dioxide poisoning or by oxygen deprivation.

In certain embodiments thereof, the air permeable material and air dispenser preferably comprise respective layers of reticulated foam. The air circulation flow rate may also be limited so as to prevent excessive cooling of the infant. For example, the air flow rate may be limited to no more than about twice the tidal volume of the infant, where tidal volume is defined as the volume of air breathed by an infant in one minute.

Yet another construction comprising a present exemplary embodiment relates to a crib safety apparatus for the prevention of sudden infant death syndrome due to carbon dioxide poisoning. Such apparatus preferably comprises in combination a generally rectangular mattress, fabric cover means, and air pump means.

Such generally rectangular mattress may be formed by an upper layer of air permeable material so as to be received in a crib, with the upper layer defining a generally flat upper support surface for receiving an infant thereon with the infant's head situated adjacent a predetermined target breathing space associated with a selected region of the upper support surface. Such mattress further defines a breathing space non-blockable air dispenser means defining a predetermined volume beneath such selected region, for supplying a flow of air to such breathing space which is effectively not blocked by placement of an infant's head adjacent the predetermined target breathing space.

Such fabric cover means may be fitted at least about the mattress upper support surface and may be comprised of air and liquid permeable material. Such arrangement permits the flow of oxygenated air therethrough upwardly towards the target breathing space, while permitting the flow of regurgitated fluids and body fluids downwardly from the infant towards the mattress upper level.

Such air pump means preferably draws fresh oxygenated air, such as from around the crib surroundings (or from another source to which access has been provided), and pumps such fresh oxygenated air into the breathing space via the non-blockable air dispenser means. Such arrangement expels the carbon dioxide from the breathing space and presents fresh oxygenated air to the infant instead of the accumulated exhaled carbon dioxide. Such benefit is obtained even whenever the infant is received face down onto the mattress upper support surface target breathing space.

A still further present exemplary embodiment concerns a two-zone crib safety pad for preventing SIDS. Such a safety pad may comprise an upper support layer comprised of air permeable material, a two-zone bladder dispenser means, and forced air circulation means operative therewith.

The two-zone bladder dispenser means is situated below the upper support layer and is operative with oxygenated air supplied thereto, for differentially dispensing oxygenated air to two separate zones defined thereby. Such zones are characterized by respective relatively higher and lower oxygenated air flow rates. The differentiated flow rate zones are extended to an infant received on the upper support layer by the air permeability of such layer.

Operation of the forced air circulation means circulates oxygenated air via such dispenser means to an infant received on the upper support layer. Such an arrangement advantageously permits a relatively higher risk infant to be placed in the vicinity of the portion of such layer associated with the relatively higher oxygenated air flow rate zone as determined by the dispenser means.

Still further aspects of the subject invention relate to a patient care pad having a low air loss surface for providing cooling and drying effects to a patient received thereon. Such a patient care pad may comprise a sheet like bladder and air introduction means associated therewith.

Such sheet like bladder may include upper and lower air impervious mutually sealed sheets with a non-blockable layer of air permeable material sandwiched therebetween. Reticulated foam is a preferred material. The upper sheet has a predetermined pattern of porous air permeable regions defined therein. The bladder has at least one opening thereto for the introduction of pressurized air to the bladder. The air introduction means conducts pressurized air to such bladder. The pressurized air emerges through the upper sheet air permeable regions at a predetermined flow rate adequate to provide cooling and drying effects to a patient received thereon, which flow rate is controlled or otherwise determined by operation of the air introduction means.

In the foregoing embodiments, other optional features may be used. For example, the air to be circulated may be heated or cooled for having the same effect on the infant, or the oxygen content of such air can be enhanced (i.e., enriched).

It should be well understood by those of ordinary skill in the art that the present invention equally pertains to corresponding methods, a present exemplary embodiment of which relates to a method of preventing infant asphyxiation during periods of infant bed rest, such as in a crib. One exemplary such method broadly relates to the steps of providing a support pad having an upper support surface and comprised of air permeable material therebeneath so that a breathing space is created below an infant received on such upper support surface, and circulating oxygenated air through such breathing space so that carbon dioxide exhaled by an infant received on the upper support surface is flushed from the breathing space so as to prevent asphyxiation of the infant due to carbon dioxide poisoning.

Those of ordinary skill in the art will better appreciate the features and aspects of such embodiments, methods, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
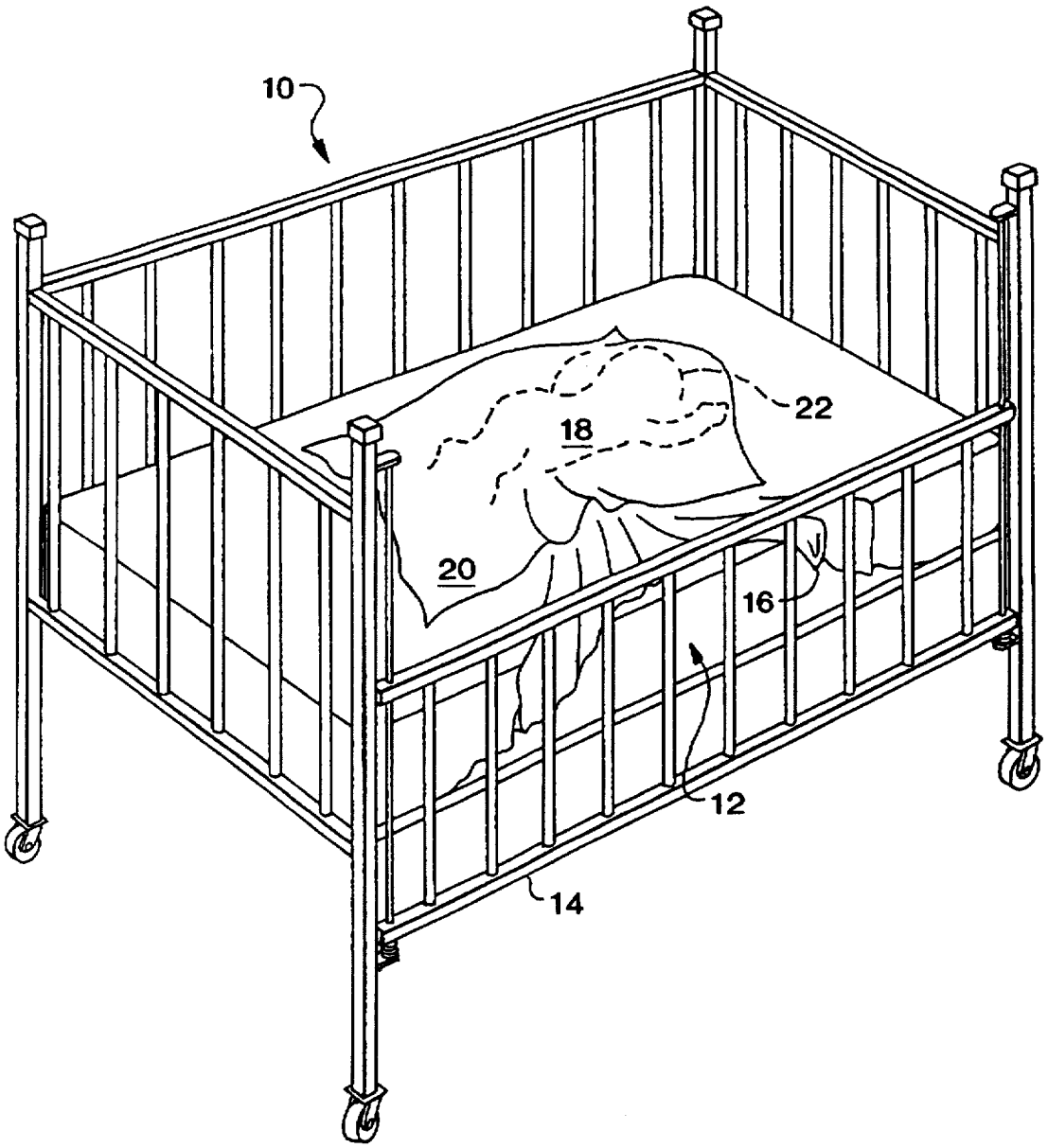
FIG. 1 PRIOR ART
FIG. 1 is a perspective view of a typical conventional or prior art crib with an infant received thereon in a prone position.

Repeat use of reference characters throughout the present specification and appended drawings is intended to represent same or analogous features, elements, or steps of the invention.

DETAILED DESCRIPTION OF THE PREFERRED EMBODIMENTS

FIG. 1 is a perspective view of a typical conventional crib generally 10 which may receive and support a conventional crib mattress 12 therein. The construction and support features of conventional crib 10 are generally well known to those of ordinary skill in the art and form no particular aspect of the subject invention, wherefore additional details of such crib 10 are not provided. One movable side 14 of crib 10 is lowered in the illustration of present FIG. 1 for greater clarity during the following discussion, though it will be understood that such side 14 is more typically in a raised position whenever the crib is occupied.

Oftentimes a relatively loose fitting sheet, mattress cover, or the like (generally 16) will be provided because mattress 12 has a vinyl or other plastic protective covering which would be relatively uncomfortable if received directly against an infant 18. When loose fitting, sheet 16 can become drawn up by movement of the infant, as represented in FIG. 1. On occasion, an additional blanket or covering 20 is applied for the warmth of the child 18. As represented in present FIG. 1, an infant may become accidentally entangled in the bedding mass or cloths comprising sheet/cover 16 and blanket 20, and other materials if present. On occasion, as represented, the head 22 of the prone positioned infant 18 is literally face down or otherwise turned so as to be blocked by mattress 12 and/or the bed clothing from a free flow of air, particularly fresh or oxygenated air. With such an arrangement, the potential for SIDS exists, as described above in detail.

Figure 2:
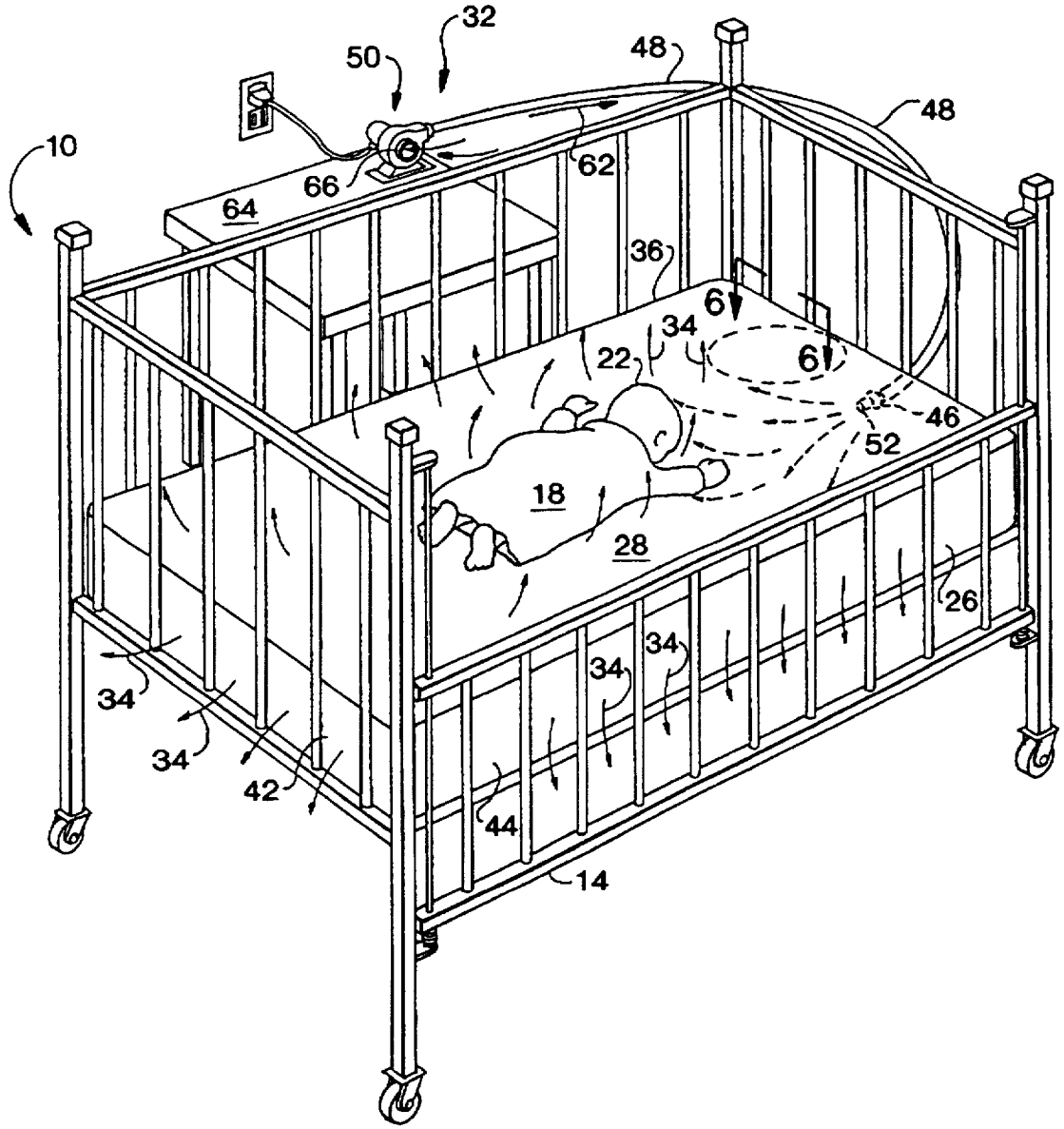
FIG. 2 is a view of a typical conventional crib such as shown in present FIG. 1, with an infant received thereon in a prone position, shown in combination with a first embodiment of an infant safety pad or mattress and corresponding methodology in accordance with the subject invention.

FIG. 2 illustrates another perspective view of typical or conventional crib 10 with an infant 18 received therein, but this time with other features in accordance with the subject invention combined therewith in place of conventional mattress 12, mattress cover 16, and the like. Again, crib side 14 is lowered for greater clarity in the illustration.

Figure 3:
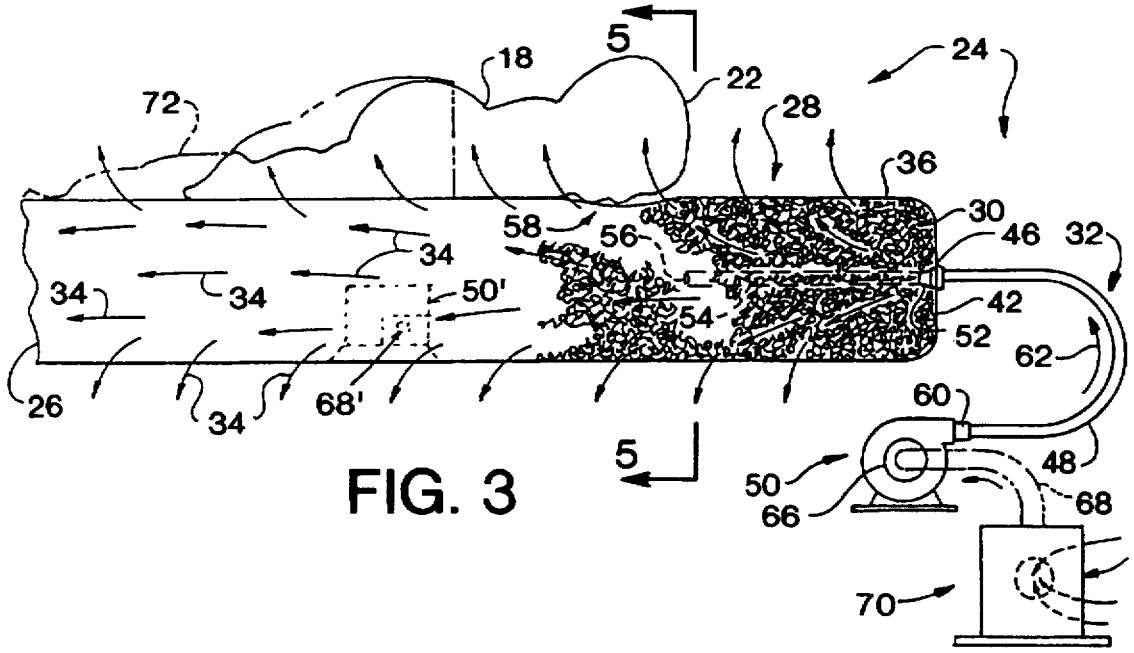
FIG. 3 is a generally side elevational view of a portion of the present apparatus and methodology represented in accordance with the exemplary embodiment of present FIG. 2.

FIG. 3 illustrates a side cross-sectional view (with some diagrammatical illustrations) of an exemplary infant safety device comprising a mattress or pad generally 24 comprising a first embodiment in accordance with the subject invention for apparatus and methodology for the prevention of infant asphyxiation during bed rest such as in a crib.

With reference to both FIGS. 2 and 3, a support pad generally 26 has an upper support surface 28 on which an infant 18 may be supported. The support pad is comprised of air permeable material 30 which resides beneath support surface 28 for the creation by such material of a breathing space below infant 18 received on upper support surface 28.

Forced air circulation means generally 32 functions for circulating oxygenated (i.e., fresh) air through the breathing space beneath the infant 18 so that carbon dioxide exhaled by an infant received on surface 28 is flushed from such breathing space. Such function prevents asphyxiation of the infant due to carbon dioxide poisoning.

As illustrated throughout FIGS. 2 and 3 by numerous air flow lines, such as lines 34, air from forced air circulation means 32 is sent throughout the breathing space formed by support pad 26. Not only is fresh or oxygenated air brought into the breathing space by such arrangement, but equally important, any carbon dioxide exhaled by infant 18 and any other potentially harmful gases are flushed or purged from the breathing space.

Figure 4:
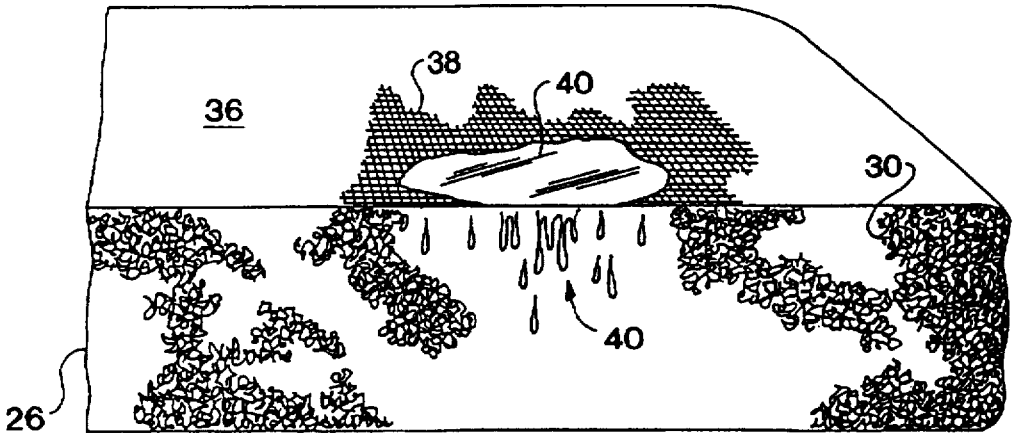
FIG. 4 is an enlarged side cross-sectional view of a portion of the embodiment of present FIG. 3.

FIG. 4 illustrates an enlarged cross-sectional view of present support pad 26 in accordance with a first embodiment of the subject invention comprised of air permeable material 30, and further alternately including in accordance with the subject invention fabric cover means 36. As shown in FIGS. 2 through 4, such fabric cover means are preferably fitted relatively tightly at least about the upper support surface 28. Furthermore, such fabric cover means when used are comprised of preferably air permeable material, which stills permits carbon dioxide to be flushed from a breathing space and oxygenated air to be circulated therethrough, as represented by present FIGS. 2 and 3.

Fabric cover means further preferably includes a relatively open weave washable fabric covering 38, as shown in FIG. 4. Not only is such an arrangement effective for the passage of gases as discussed above, but regurgitated fluids generally 40, such as milk, juice, or sugar water, may be drained through fabric 38 and away from an infant's face.

Still further, FIGS. 2 through 4 illustrate that fabric cover means 36 may be fitted about the upper support surface 28 and surfaces adjacent thereto such as sides 42 and 44. In such instances, the fabric covering 36 preferably includes at least one tube opening 46 formed therein, for purposes as discussed hereinafter.

Forced air circulation means generally 32 preferably comprises an air tube 48 (see FIGS. 2 and 3) at least partially embedded in support pad 26, and an air pump generally 50 operatively interconnected with air tube 48 and operating for forcing oxygenated air into such air tube. Preferably, such operation is continuous and at a relatively constant predetermined air flow rate. An air flow rate of generally less than about 1 cubic foot per minute is preferred in many instances so that the circulation of air will not have any undesired cooling effect against the skin of infant 18. Of course, in some embodiments, use of relatively higher air flow rates (such as above 1 cubic foot per minute) may be practiced intentionally for creating a corresponding cooling effect. Other methods of obtaining a cooling effect (or a desired heating effect) may be practiced in accordance with the subject invention, as discussed in greater detail below.

The air pump means comprising a combination of air pump 50 and air tube 48 draws fresh oxygenated air preferably from around the crib surroundings, although specific air sources (such as with an oxygen tank or the like) could be utilized in some embodiments of the subject invention. From whatever source, the oxygenated air (either pure oxygen, oxygen enriched air, or available fresh air with nominal oxygen levels) is pumped into the breathing space formed by pad 26 so as to expel any carbon dioxide from such breathing space and present fresh oxygenated air to the infant instead of accumulated exhaled carbon dioxide even whenever the infant is received face down onto the mattress upper support surface 28 as represented in present FIGS. 2 and 3.

Tubing 48 preferably may comprise flexible plastic tubing. Different embodiments may be practiced, including the use of reinforced hoses, similar to those of a vacuum cleaner or the like, reinforced heavy cloth or fabric tubing, or sections of hardened plastic tubing with flexible interconnections.

While tubing 48 may have a terminus point 52 just inside pad 26 as represented in present FIGS. 2 and 3, the dotted line illustration of present FIG. 3 shows an additional length 54 of such tubing so as to position an end 56 thereof relatively adjacent to a portion of mattress 26 where the head or face 22 of an infant recumbent thereon is intended to be placed. The predetermined position of end 56 can be varied depending on the size of the pad and/or the size of the infant. For example, the distance between end 56 and opening 46 could be varied within a given range, such as from about 10 to about 30 inches.

With reference to FIG. 3, in such instances of an extended length 54, the present breathing space in accordance with the subject invention may be considered to be the area more closely associated with the region in and around such end 56 and the nose and mouth in the front area 58 of the infant's head 22. In such instances, the broader aspects of the subject invention would still be applicable in that such breathing space would be purged of carbon dioxide accumulations in accordance with the subject invention, and the infant would instead be presented with fresh or oxygenated air. An opposite end 60 of tube 48 preferably is directly interconnected with air pump 50 so that air input to such end 60 is forwarded in the direction of arrows 62 so at to be forcibly circulated in the above-referenced breathing space.

As noted, the predetermined location of end 56 may be varied in accordance with the subject invention so as to accomplish the purposes set forth above. Such position could also be adjustable, which would be a particularly useful feature over the infancy of a child 18 since the intended or likely head location of an infant might move as the infant grows. An infant may be only about 18 to 22 inches at birth, and then grow to 36 inches or more in only 2 years time.

As represented by present FIGS. 2 and 3, air pump 50 may be a relatively simple pump, such as electric powered, portable, and supported on a nearby table 64 or in some instances attached to or supported on crib 10. A pump similar to the air circulation pump in an aquarium set is one example of appropriate type. In general, preferred types of air pumps will avoid the direct involvement of a compressor or similar mechanism so that no contamination, such as compressor lubricant or oil, will reach the air to be circulated.

Particularly as represented by present FIG. 2, such pump 50 may draw fresh oxygenated air from about its surroundings through a suitable opening or air filter in area 66 thereof. On the other hand, in some embodiments of the subject invention, a further tube 68 (FIG. 3) may be used for providing a specific source of oxygen or oxygenated air to air pump 50. As shown in FIG. 3, exemplary means 70 connected to tube 68 may comprise oxygen regulation means for controlling the amount of oxygen (i.e., nominal, enriched, or pure) supplied to air pump 50 and circulated. Alternatively, such means may be considered to represent air temperature regulation means or conditioning means 70 which may be further provided for desirably or selectively heating or cooling the supply of air 68 to air pump 50. In such fashion, an infant 18 may be effectively warmed even without use of an exterior blanket 72 or alternatively cooled, all from the air circulated thereto through tube 48. In other words, nominal temperature (and/or specific oxygen content) of the air circulated through the breathing space in accordance with the subject invention may be regulated or controlled in a desired fashion. A space heater, electric or otherwise, or a small air conditioner or fan unit or other cooling means may be practiced, the details of which are well known to those of ordinary skill in the art and form no particular features of the subject invention, wherefore further discussion thereof is omitted.

Additional optional arrangements are represented in present FIG. 3. Specifically, where a mattress of adequate size is utilized, air pump 50 may alternatively be at least partially received within such mattress. Such optional placement of an air pump is diagrammatically represented by the dotted line illustration of 50' in FIG. 3. Suitable access to oxygenated air (or oxygen enriched air, heated air, or cooled air) may be provided by alternative sources outside of support pad 26. A valve or nozzle attachment or similar for receiving a connector hose is diagrammatically represented in the dotted line illustration of 68' in present FIG. 3.

In addition to being representative of the above-referenced alternative source, such connector means 68' may receive pressurized air, such as from a pressure tank or from a hospital room source, as is generally readily available. The pressure of such an input may be further regulated with appropriate devices as readily known to those of ordinary skill in the art. The regulated desired level may constitute an additional or higher flow rate than would otherwise be typically practiced, so as to alternatively intentionally induce a cooling effect on the infant 18 received on mattress 26 (or for any other patient utilizing a structure of this type).

Without an additional pressurized source, it is more typically preferred for most embodiments that the air flow rate within mattress 26 (whether generated by air pump 50, 50', or some other source) is preferably limited so as to not cause a cooling effect. For example, the tidal volume of an infant is about 0.9 liters per minute. Tidal volume is defined as the average volume of air breathed by an infant in one minute. Limiting the air flow rate of the subject invention to no more than about twice the tidal volume, for example, limited to 2000 milliliters per minute, helps prevent any unintended cooling effect on the infant.

At the same time, the flow rate advantageously helps alleviate undesired and potentially dangerous collections of carbon dioxide. As a gas, carbon dioxide is relatively heavier than oxygen and tends to move downward and potentially accumulate in pockets. A newborn infant has a lung capacity of about 30 milliliters, and would fill any such small pocket with exhaled breath in a matter of seconds. If faced into such a pocket or collection, the infant would in effect be rebreathing carbon dioxide, which could fairly quickly have medical consequences.

At the same time, in order to fully or deeply breathe, a newborn must expand its chest, lifting its body by muscular action so as to expand its lungs. Such activity is difficult to do if an infant must raise every part of its body upward from the support surface, but is much easier to do if the lungs can expand up and down at the same time. Therefore, a relatively softer support surface is a positive factor whenever air is being supplied by positive pressure. A tighter or firmer surface, similar to a typical prior art plastic coated mattress, is a negative factor during such breathing functions.

In recognition of the fact that it is difficult for some newborns to breathe on a tight plastic surface because they lack adequate strength in the lungs to lift their body sufficiently for a good exchange of air, it is an aspect of the present invention to provide a soft surface, instead of one in tension. At the same time, due to lack of full development of an infant's reflexes, it is desired to positively prevent the accumulation of carbon dioxide from exhaled gases, which otherwise could pose a danger of carbon dioxide poisoning. More developed reflexes permit a subject to respond and move to oxygenated air. Newborns and younger infants are therefore generally at greater risk for carbon dioxide poisoning.

The present construction provides adequate passageways and pressure differentials to allow for movement of carbon dioxide, which since it is heavier than oxygen, would tend to be downward movement. The permeability and porosity of the presently disclosed materials are important since they cooperate with the incoming air to drive out or disperse (i.e., dilute) the carbon dioxide, while at the same time providing oxygenated air in its place.

A pad of porous and permeable materials such as virgin non-woven nylon or reticulated foam having 30 or less pores per inch, provides a sufficient unblocked passage for oxygen and carbon dioxide gases in the vertical and horizontal directions going to and from the infant, in the illustrated embodiment. By combining such structure with a pump having a fixed maximum output not to exceed, for example, 2000 milliliters per minute, such volume spread over the pad area prevents excessive cooling while still providing adequate volume flow to assure supply of oxygenated air and dispersal of other (i.e., undesired) gases.

In one preferred embodiment, the design of the dispersal pad is such that the holes in the pad are configured to disperse air equally over the total surface. This is accomplished by having the cross-sectional area of the holes equal, for example, to the internal diameter of the air supply tube being used. With the pad constructed so as to maintain a flat configuration, air is dispersed uniformly and exhaled carbon dioxide does not accumulate inside the mattress.

Therefore, such embodiments make use of relatively high levels of permeability and porosity in both the horizontal as well as the vertical plane of the material, combined with positive displacement and dispersal of exhaled gases. The arrangement also creates an unblockable air supply pathway while at the same time providing pad absorption for vomitous or regurgitated materials, or other bodily fluids. Still, the arrangement permits use of an antimicrobial material, to reduce the potential for infection. With the positive air supply pressure limited, for example, to not more than twice the tidal volume, the air supply delivery is dispersed with the dispenser arrangement so as to prevent infant hyperthermia. The resulting pad or mattress arrangement is still easily washable, to promote hygiene.

As represented in FIGS. 2 through 4, support pad 26 preferably comprises a generally rectangular crib mattress comprised of air permeable material 30. One preferred embodiment of such permeable material comprises reticulated foam. The manufacture of such foam is well known to those of ordinary skill in the art, and can make use of either chemical or thermal manufacturing techniques so as to create foam which is resilient similar to nonreticulated foam but which is rendered relatively air (and liquid) permeable. In other words, major interconnecting walls between foam cells are eliminated by the reticulation process so that a relatively open network of pores or openings remains, which is readily permeable by gases and liquids. With such an embodiment, the reticulated foam could also be rendered washable so as to remove or wash therefrom undesired fluids such as 40 (see FIG. 4) after a period of usage.

As further understood by those of ordinary skill in the art from the disclosure herewith, such generally rectangular mattress defines a breathing space of predetermined volume beneath the upper surface thereof, which volume in some instances may simply be the volume resulting from the combined length, width, and thickness (or depth) characteristics of the mattress. In the case of a conventional crib mattress, length of approximately 51 inches, width of approximately 28 inches, and thickness of approximately 6 or 6½ inches is common place. In preferred infant safety device embodiments of the subject invention comprising a full mattress substitute for a conventional crib mattress, the length of the mattress has a range preferably generally of about 45 to 55 inches, a width generally in a range of from about 25 to about 35 inches, and a thickness generally in a range of from about 4 to about 8 inches. Some present embodiments may comprise a relatively reduced size pad to be received onto another support element such as a main mattress. One such present pad embodiment may be about 30 inches in length, 20 inches in width, and 0.75 inches in thickness, though other pad dimensions may be practiced. For example, pad length may have a range of about 25 to about 35 inches, pad width a range of about 15 to about 25 inches, and pad thickness a range of about 0.5 to about 2 inches.

Figure 5:
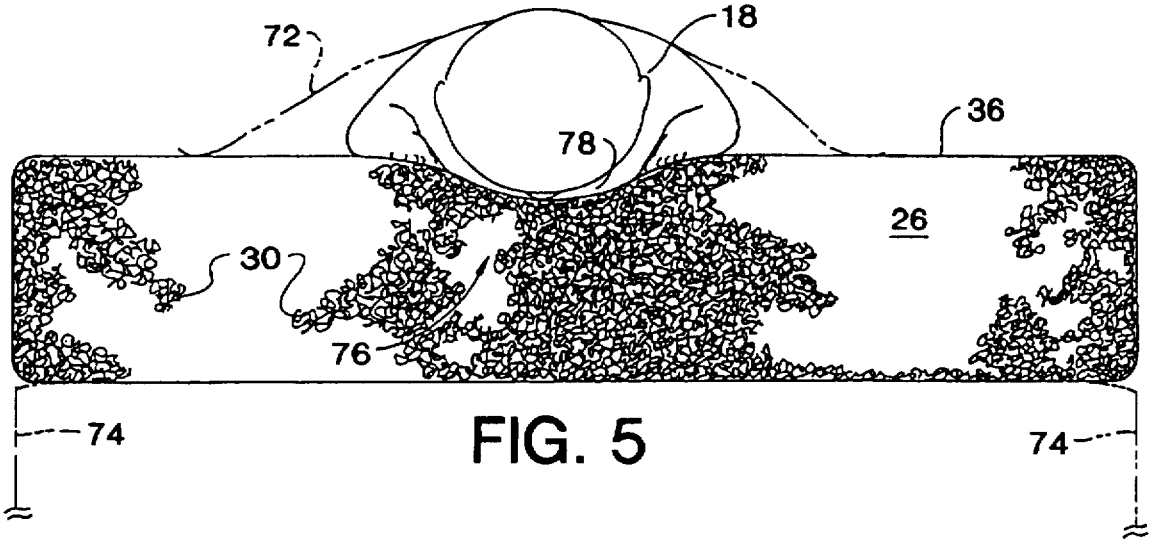
FIG. 5 is a further enlarged cross-sectional view of the embodiment of present FIG. 3, taken along the sectional line 5—5 indicated therein.
Figure 6:
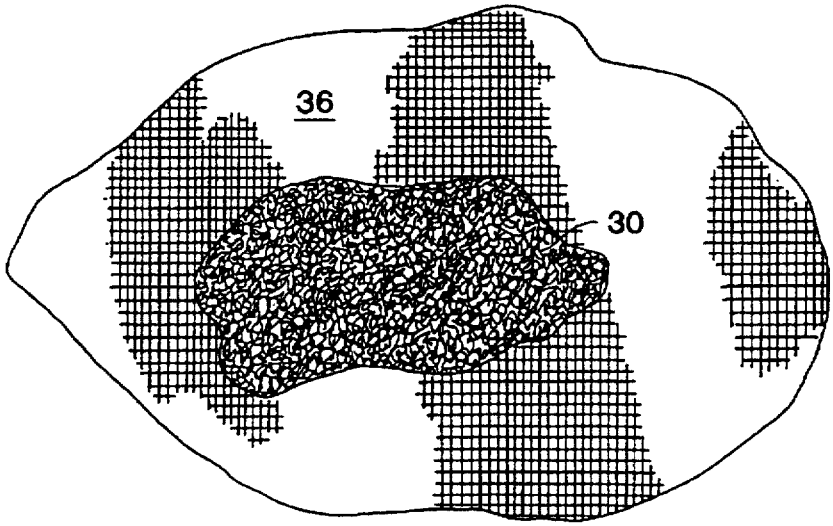
FIG. 6 is an enlarged partial sectional view of the region marked by section line 6—6 of present FIG. 2.

As represented in the cross-sectional view of present FIG. 5 (taken along the sectional line 5—5 of present FIG. 3), a support pad 26 in accordance with the subject invention may be used in combination with a further resilient or nonresilient support pad or other support element 74 therebeneath (represented in dotted line). Such representation is not necessarily intended as being drawn to scale since pads in accordance with the invention could appear much smaller (or even larger) relative to infant 18 and support 74. As shown in such figure, a breathing space generally 76 is formed in accordance with the subject invention in and about the face 78 of an infant 18 because of the reticulated foam or air permeable material 30 utilized throughout the construction of pad 26. FIG. 6 also represents a top view of such air permeable material 30 shown in partial cut-away in combination with fabric covering 36, which is also of air permeable material, as discussed above. Therefore, even whenever an infant is completely face down (a relatively worst case scenario), the present invention provides a support pad which creates a breathing space of air permeable material beneath the infant and circulates oxygenated air through such breathing space so as to dispel and flush out any exhaled carbon dioxide to prevent asphyxiation of the infant, and instead to provide fresh or oxygenated air to the infant for the prevention of SIDS from asphyxiation.

As will be appreciated by those of ordinary skill in the art, variations and modifications to the subject invention may be practiced. For example, support pads of different sizes may be practiced, even beyond those discussed above. In general, the size of the air tubing should be less than the thickness of the pad, but the pad thickness could otherwise be reduced in some embodiments as discussed above.

Similarly, while the subject invention is advantageously usable with infants not previously identified as being at risk, the invention is equally applicable to children and others older than infants who have been identified for at risk conditions. For example, some children may have been diagnosed with specific instances of breathing stoppage, or may possess other specific breathing disorders such as asthma or other conditions which would expand the risk sphere described above with respect to suspected SIDS causes from carbon dioxide poisoning. At the same time, practice of the subject invention advantageously permits total freedom of movement for the user infant or child since the entire arrangement is virtually transparent to the user, at least in that it does not involve use of an anesthesia mask or air tube to the nostrils of the user, or an overhead oxygen tent.

Figure 7:
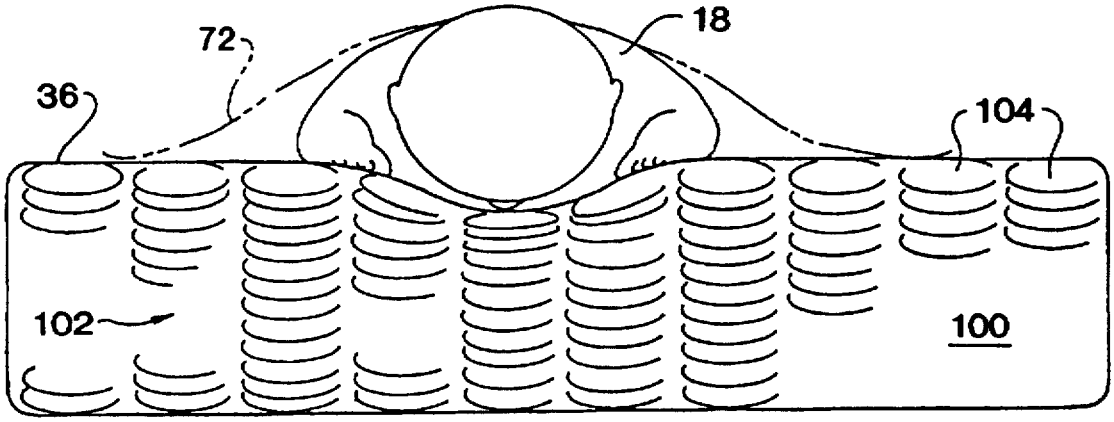
FIG. 7 is an enlarged cross-sectional view similar to the view of present FIG. 5, representing a second embodiment in accordance with the subject invention.

Still further, it will be understood by those of ordinary skill in the art that different air permeable materials may be practiced so as to provide a resilient mass of relatively open weave matter, such as represented by present FIG. 7. FIG. 7 illustrates a second exemplary embodiment of the subject invention having a pad 100 comprising an example of such relatively open weave matter 102. More specifically, the exemplary material 102 of present FIG. 7 may comprise resilient coils 104 formed such as from metal or plastic materials, and defining open air permeable passages in and around the coils thereof. The wire fabric of ventilated cushions for automobiles is one example of suitable material.

FIG. 7 illustrates a cross-sectional view of pad 100 similar to that illustrated in present FIG. 5, and again representing the optional included use of a fabric covering 36 and a blanket or covering 72 for infant 18. Use of variably or fixed embedded tubing such as tube extension 54 of present FIG. 3 may likewise be practiced, and other advantageous features of the prior embodiment (such as the liquid drainage represented in present FIG. 4) may also be obtained through practice of the FIG. 7 embodiment. For example, tube end 56 may be positioned a predetermined distance in mattress 26 or mattress 100 from fabric covering tube opening 46 so that the air tube first end 56 is situated relatively adjacent an area of the pad or crib mattress 26 where the head 22 of an infant recumbent thereon is intended to be placed.

Similarly, other features described above may be practiced in combination with mattress pad 100, which in general may be substituted for the mattress pad embodiment 26 as shown and described above in detail.

Additional alternative embodiments of the subject invention may be practiced. Such embodiments may variously incorporate features referenced above, or include combinations of some of such features and other features, as discussed hereinafter.

FIGS. 8 through 11 represent various respective views of non-blockable supplemental air dispenser or dispenser means features in accordance with the subject invention. As represented in FIG. 12, such features may be further incorporated into additional structures so as to constitute a support pad, also in accordance with the subject invention.

It can be very difficult to disperse air over a specific surface area of a pad if there is any material above the opening or openings out from which the air is being pumped. In certain embodiments and arrangements, and for certain particular applications, reticulated foam performs better as a dispenser (or disperser) layer for air than do certain other air permeable materials, such as a resilient mass of relatively open weave matter or nonwoven material. For example, nonwoven materials very readily disperse air in a horizontal direction. Such very high degree of horizontal permeability and porosity can make it difficult to reduce the concentration of carbon dioxide immediately above the pad, for example, even less than one-half of an inch away.

Since an average infant breathes approximately 0.9 liters of air per minute and exhales a residual gas which is about 5 percent carbon dioxide, a volume of about 45 milliliters of carbon dioxide is generated per minute.

Collective recognition of the above facts identifies a very specific problem to be addressed.

In accordance with the subject invention, it has been further determined that newborn infants up to about 3 months essentially remain or lie in the same position which they are placed by their caregivers. In the weeks after birth, as they get stronger, they obtain the ability to turn their head. In general, SIDS deaths are indirectly proportional to age. In other words, the greatest number of deaths occur very early in life, such as in the first three or four months. Generally speaking, a baby gains the ability to roll over between the third and tenth month. Consequently, as such motor skills progress, and as the baby can move, the risk of SIDS occurrence decreases. Essentially, a practical risk has ended by about the tenth month. Therefore, the particularly high risk infants are those between birth and age three to four months,the time period whenever the infant is relatively immobile.

The present invention recognizes the collective impact of such factors and uses such recognition to provide further present exemplary embodiments. Specifically, if a focus or concentration point for air flow could be established and at which a newborn or very young infant could be placed (for example, during the first three months of life), then the greatest benefit would be achieved for the infants at highest risk. In other words, the net effect of concentrated efforts for dilution while supplying fresh or oxygenated air, significantly reduces the possibility of oxygen depravation or carbon dioxide poisoning for those patients most susceptible to SIDS.

More specifically, design of a supplemental air dispenser which cannot be blocked by the pressure of a child's head while dispensing air into the selected area of the infant's nose and mouth, places a secondary or supplemental flow of oxygenated air at a precise location where it is (1)most needed by the highest risk infants and (2)most often would otherwise be blocked by an air impervious plastic cover of a conventional crib mattress.

Any approach by which an infant is lying on the surface of a vinyl air dispenser situated directly beneath the mattress sheet has the potential for the same effects as caused by a plastic coated mattress. Also, such an arrangement for such very young infants would prevent the mattress absorption of regurgitated material. Any holes in such a dispenser arrangement might become blocked. To ensure ready access of oxygenated air to the area of possible need, in accordance with this invention, a non-blockable distributor layer may be placed directly above a non-blockable dispenser layer. In such a manner, any restriction or diversion of the desired air flow from the desired area is prevented, and the target area is continually flooded with supplemental oxygenated air.

FIGS. 8 through 11 represent non-blockable air dispenser features which may be incorporated into a completed pad as represented by present FIG. 12.

Figure 8:
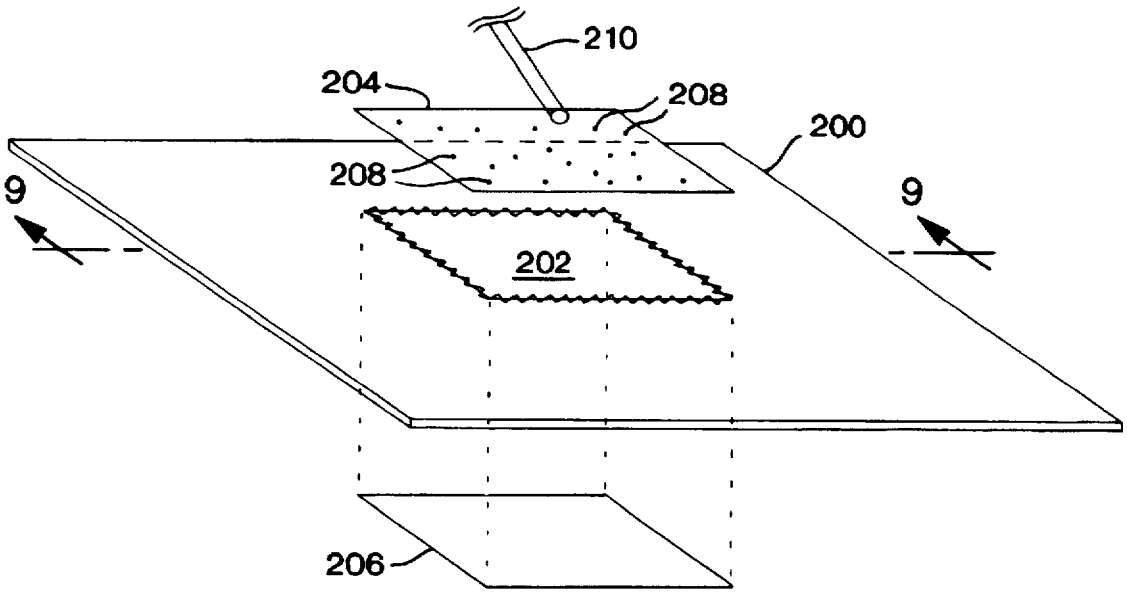
FIG. 8 is an exploded perspective view of nonblockable air dispenser features in accordance with one exemplary embodiment of the subject invention.

FIG. 8 is an exploded perspective view showing a core 200 of relatively thin air permeable material. In one example, a section of reticulated foam approximately one-quarter of an inch thick is used. A breathing space is formed by sandwiching the defined region 202 of air permeable material 200 between respective upper and lower air impervious sheets 204 and 206. Vinyl sheets or similar air impervious materials may be utilized.

As represented in FIG. 8, a plurality of air passageways 208, such as air openings or holes, may be formed through the upper air impervious sheet 204. Such air passageways together with defined region 202 establish a predetermined breathing space in which oxygenated air is circulated (whenever such structure is otherwise operatively combined with present air circulation features). The number and placement of such air openings may be varied, so as to control the air flow to the infant patient, when considered in conjunction with the other physical factors affecting flow rate, such as the output of air being provided to the arrangement.

For the sake of simplicity in illustration, an air hose 210 is represented as supplying oxygenated air into the space between the upper and lower sheets 204 and 206. Virtually any of the sources otherwise discussed in the present specification may be associated with air hose 210 for supplying such oxygenated air, so long as a positive air pressure is established in such air tube 210. The interconnection of such sources to air tube 210 is not specifically illustrated in FIG. 8, but will be well understood by those of ordinary skill in the art from the remainder of the present specification and drawings.

In one exemplary embodiment, defined region 202 may be provided as a rectangular area or portion covering about 4 inches by about 6 inches of the overall larger piece of air permeable material 200. Upper and lower sheets 204 and 206 may be about the same size or slightly larger than region 202, so as to encompass the defined region. Such two elements 204 and 206 may be mutually sealed (such as by RF welding or heat welding) so as to effectively seal defined region 202. At the same time, air tube 210 is introduced into such bladder arrangement (i.e., the opposing vinyl sheets sandwiched around the reticulated foam), so that a positive flow of oxygenated air may be introduced into the bladder and therefore dispensed and dispersed to a patient through air passageways 208.

In such an embodiment, with layer 200 approximately one-quarter of an inch thick, an air pump having an output of approximately 3.5 liters per minute is generally adequate to provide the desired level of supplemental air flow over region 202 but without causing any undesired cooling effect. A formula in accordance with the present invention for approximating the requisite pump size is calculated by utilizing up to about 150 milliliters of air per minute per square inch of surface (defined region) to be supplied. In general, it is preferred to add an additional amount (such as about 10 or 15 percent) to such calculation to help offset any possible losses created by the dispersal effects of the distributor layer of the pad.

Figure 9:
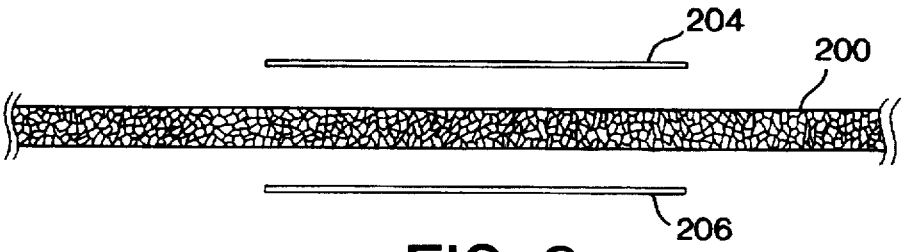
FIG. 9 is an enlarged, exploded cross-sectional view of the features of FIG. 8, taken along sectional line 9—9 shown therein.

FIG. 9 represents a generally cross-sectional view of the structure of FIG. 8, taken along the sectional line 9—9 therein. The hatching illustrated for core element 200 is intended to generally represent the air permeable nature thereof, such as for reticulated foam. As further generally represented, upper and lower air impermeable sheets 204 and 206 may be much smaller than the core element 200. Such an arrangement advantageously permits the overall non-blockable air dispenser to be incorporated into a desired support pad, as further discussed herein.

Figure 10:
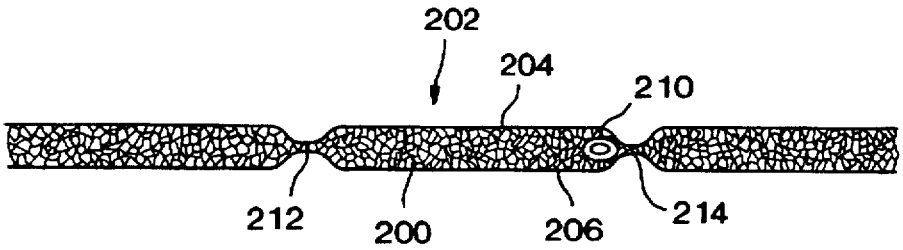
FIG. 10 is an enlarged, assembled cross-sectional view of the features represented in present FIG. 9.

FIG. 10 represents an assembled, generally cross-sectional view of the subject matter as represented in FIG. 9. An end of air tube 210 has been secured between the upper and lower seats 204 and 206, and sealed for example by RF or heat welding lines 212 and 214, as represented. As further shown by FIG. 10, the air impermeable layers may also extend beyond the defined region 202 so as to be incorporated into other support pad combination structures. The essential nature of the defined region 202 is that the sheets 204 and 206 have been mutually sealed so that the portion of the air permeable material or reticulated foam in such region is encased thereby and provided oxygenated air through tube 210 for being dispersed throughout the encased area and forced therefrom through appropriate air passageways in sheet 204.

Figure 11:
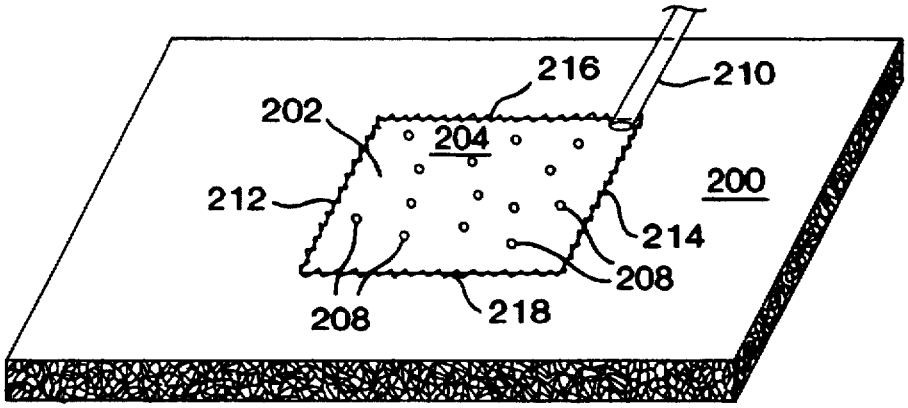
FIG. 11 is a perspective view of the assembled features of present FIG. 10.
Figure 12:
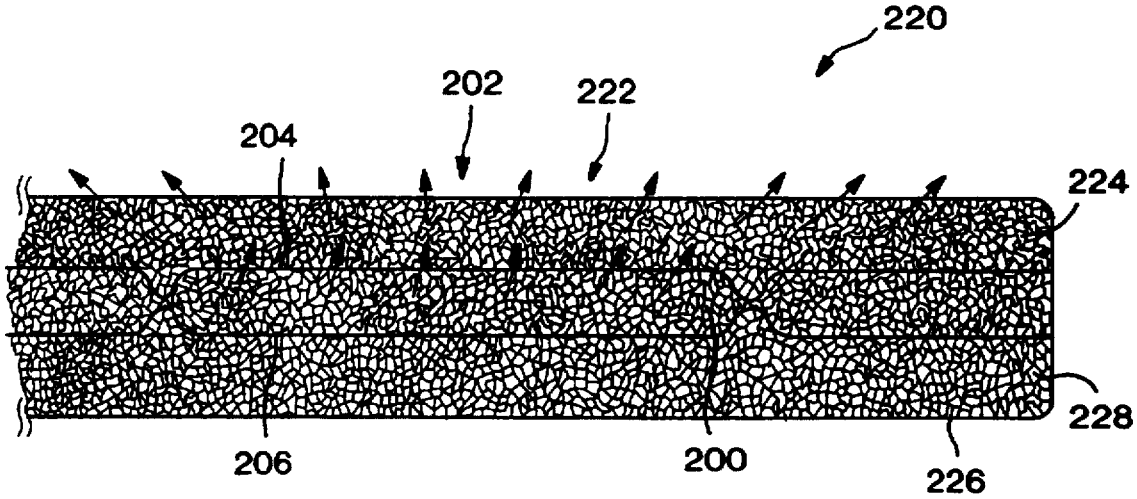
FIG. 12 is a diagrammatical representation of a cross section of an exemplary support pad in accordance with the subject invention, incorporating the air dispenser features represented in present FIGS. 8 through 11.

FIG. 11 represents a generally top perspective view of an assembled group of components as represented in exploded view in present FIG. 8. A rectangular defined region 202 is formed by weld or seal lines 212, 214, 216, and 218. Other region shapes could be practiced, such as round or other geometric or non-geometric shapes.

FIG. 12 represents the structure of FIG. 11 incorporated into a support pad in accordance with the subject invention. In such arrangement, such support pad generally 220 is shown in diagrammatical cross-sectional view. Support pad 220 has an upper support surface generally 222 formed by a first layer of air permeable material, generally 224. In one preferred embodiment, such material may also be a layer of reticulated foam approximately one-quarter of an inch thick. First layer 224 performs the function of distributing oxygenated air received from the non-blockable air dispenser arrangement formed with core 200 and mutually sealed upper and lower sheets 204 and 206.

Forced air circulation means such as an air pump or the like is attached via the above-described air tube 210, or other appropriate means, for circulating oxygenated air through a defined breathing space via the air dispenser. Hence, carbon dioxide exhaled by an infant received on the upper support surface 222 is flushed from the breathing space therearound so as to prevent asphyxiation of the infant due to carbon dioxide poisoning. At the same time, oxygenated air is thereby provided for inhaling by the infant so as prevent asphyxiation of such infant due to oxygen depravation. In combination, such features form an infant safety device in accordance with the subject invention for the prevention of infant asphyxiation.

A number of flow lines (without reference characters) are illustrated in FIG. 12 to represent the flow of oxygenated air. Air is first passed through upper membrane or sheet 204 via the air passageways 208, as described above. Particularly with use of reticulated foam, such arrangement is unblockable in the function of passing oxygenated air into first layer 224. Relative to passing oxygenated air to upper support surface 222, such layer 224 is in turn unblockable due to the nature of the air permeable material used therein.

For example, a pad with upper membrane 204 having 12 holes located in a pattern covering the area from the bridge of an infant's nose to the chin covers about 2.5 to 3 inches. The width of such an arrangement is such that the air flow extends approximately 1.5 inches beyond the infant's face, and is therefore cumulatively 6 inches wide. The effective flow of about 1.5 inches beyond the air holes may be obtained because of the effectiveness of the distributor layer 224, as represented by the somewhat angled air flow lines represented in FIG. 12.

At any given moment, the infant's head may cover a certain number of the air holes 208, such as example onehalf to two-thirds of the holes. However, such an event does not preclude oxygenated air from being available for breathing because of the combined non-blockable distribution fuctions of the two layers of reticulated foam, as described above. With such an arrangement, and with the air flow criteria referenced above, a positive flow of an infant's breathing requirements of 0.9 liters per minute can be assured.

An air permeable material such as a cotton or cotton polyester cover 226 may be provided surrounding support pad 220. Such an arrangement contributes to the tactile comfort of the infant since familiar and soothing sensations are presented.

In addition to the above positive flow of air obtained with the arrangement of FIGS. 8 through 12, the upper air distributor layer of air permeable material 224 (such as reticulated foam) makes possible the improved breathing of air from pad 220 at virtually any location (i.e., not just near region 202). This is because oxygenated air otherwise present in the room or environment can enter the upper distributor layer 224 through covering 226 at any point along the edge of the pad and likewise travel to the infant location for use. Hence, as an infant gets older and is able to move about, the remainder of the pad continues to provide a degree of protection for an alternative source of air.

With such an arrangement, a non-blockable air flow is assured beneath the patient or infant in a defined or desired region. The air permeability of the distributor layer results in low suction forces, assuring available air to be breathed all across the surface of the resulting support pad. A design formula or criteria for the size (i.e., area) of the dispenser is provided in relation to the air flow capacity of the air pump. Such fact permits the invention to be practiced in different embodiments, while permitting the ultimate designer to select variations based on other factors which may be encountered, all coming within the broader scope of the subject invention.

At the same time, the above infant safety device permits continued attention to other important aspects of infant or patient care. For example, a further layer of relatively softer resilient material 228 may be provided beneath the sealed bladder (comprising core 200 and sheets 204 and 206) for greater comfort. A nonwoven polyester material of approximately three-eights of an inch thickness is one example of a relatively softer base which may be utilized. Reticulated foam or other resilient materials may also be used. At the same time, the resulting arrangement permits regurgitated materials to be absorbed, so that the infant is not constantly presented to such materials.

Those of ordinary skill in the art will appreciate that a positive air flow is established in the defined region 202. Hence, a specific location may be indicated with appropriate indicia, so that the caregiver knows specifically where to place an infant's head (specifically nose and mouth) so assure a relatively high oxygenated air flow thereto. Beneficially also, the slight hum or similar noise which may be associated with operation of an air pump, or the slight sounds which may occur from simple air flow, may provide a source of white noise for soothing an infant and masking other, disturbing sounds from around the baby's environment.

With certain embodiments, it has been determined that reticulated foam inside the dispenser layer 200 having in a range of from about 40 to about 100 pores per inch is efficient for achieving adequate oxygenated air flow rates for diluting 5 percent carbon dioxide from accumulating at 300 milliliters per minute on the surface. The rating of 300 milliliters per minute is an approximate typical output from an infant.

The size of defined region 202 may be varied. For example, one embodiment may be a rectangular portion of layer 200 occupying about 4 inches by about 6 inches. In another embodiment, an area about 6 inches by about 6 inches may be utilized. Other sizes (and non-rectangular shapes) may also be practiced in accordance with the subject invention.

Likewise, variation in the number and placement of air holes or other forms of air passageways may be utilized, generally speaking, so long as an adequate air flow in accordance with the subject invention for carbon dioxide dilution and oxygenated air supply is provided without causing a cooling effect on the infant.

It has further been determined, particularly in conjunction with pads of larger sizes, that formation of separate zones or subzones is beneficial.

Specifically, by increasing the size (i.e., capacity) of an air pump, a larger area or pad such as about 24 inches by about 24 inches may be practiced. In such instance, subzones may be formed with variations of the above bladder dispenser arrangement, characterized by respectively relatively higher and lower oxygenated air flow rates.

Using such differentiated flow rate zones in conjunction with the infant support surface permits an infant which is at relatively higher risk (such as a newborn) to be placed in a relatively higher oxygenated air flow rate subzone. At the same time, the remainder of the pad (though having a relatively lower oxygenated air flow rate zone) provides for the needs of "older" infants, who have the capability of movement. Of course, as such movement capability progresses, the risk of SIDS and the corresponding need for prevention, relatively decreases.

For such reasons, and with practice of the multi-zone approach, smaller scale air pump capacities and other benefits from smaller scales of economy may be maintained, such that the total support pad need not necessarily cover an entire crib mattress. In other words, continued increasing in the size of a support pad in accordance with the subject invention, in general, requires continued corresponding increases in the air pump capacity. At a point in the capacity progression, the potential for air flow rate increases threatens to exceed certain limits which may cause undesired cooling or chilling effects on the infant. In general, infants have a lesser developed degree of natural temperature regulation, particularly if they are not fully healthy or if they are at risk due to other medical reasons. Therefore, utilizing a two-zone (or more) bladder dispenser means approach permits use of a generally enlarged area crib safety pad in accordance with the subject invention, while reducing the risk of inducing a chilling effect on the infant.

Figure 13:
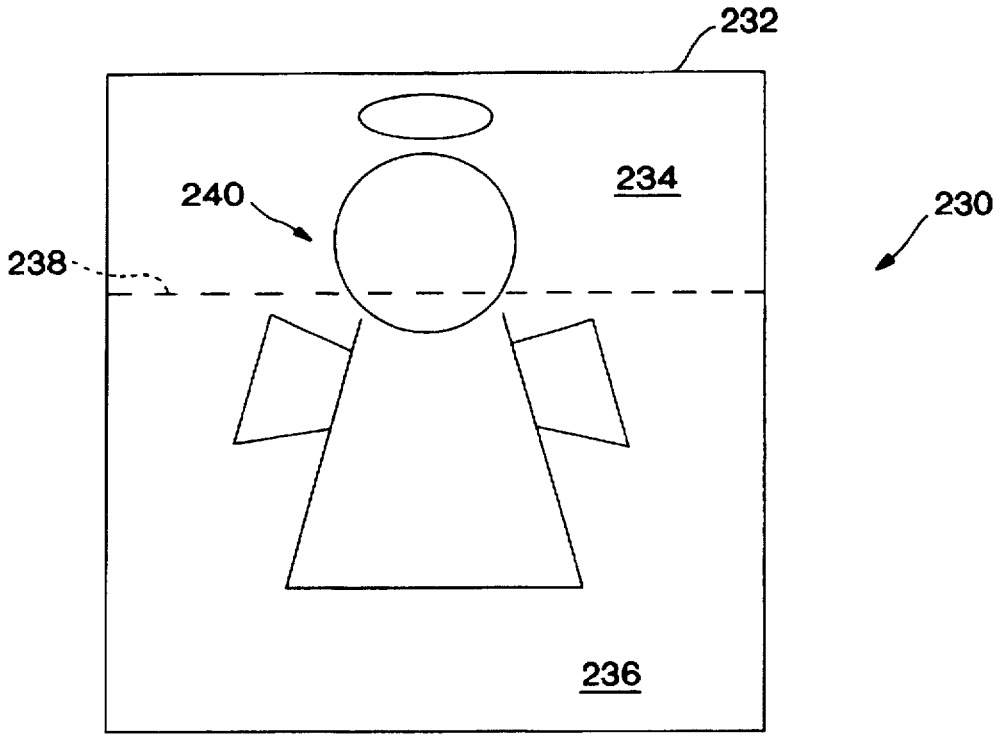
FIG. 13 is a diagrammatical representation of a top elevational view an exemplary two-zone crib safety pad in accordance with the subject invention.

FIG. 13 very generally represents a diagrammatical view of a top or front elevation of an exemplary two-zone crib safety pad generally 230 in accordance with the subject invention. In the illustrated example, a rectangular safety pad 232 of about 24 inches by about 24 inches is provided.

Respective first and second zones 234 and 236 are determined by an imaginary line 238. The respective zones 234 and 236 are characterized by having differential oxygenated air flow rates, one relatively higher than the other.

Locator means indicia or visual indication means generally 240 may be provided, since safety pad 232 may be incorporated into a larger mattress or otherwise located in sheet-like fashion upon another mattress. Such a visualization technique, in this instance, permits simultaneous indication of the location of the two zones, and the "preference" for subzone 234 as the relatively higher air flow rate zone.

In the illustrated example, a diagrammatical representation of an angel is utilized incorporating a halo and head region in the relatively higher air flow rate zone 234. A caregiver may be appropriately instructed as to the information conveyed by such a visual indication means 240. It would be expected that the caregiver would understand that a baby specified as being at risk, or a younger child, such as under three months of age, would have the nose and mouth area placed preferably close to the halo. On the other hand, a relatively older infant could be beneficially placed on any portion of the pad 232.

In the representative example of FIG. 13, pad 232 is split such that subzone 234 resides in an area covering about 8 inches by about 24 inches, while the other subzone 236 covers about 16 inches by about 24 inches. The differentiated air flow rates may be established by the placement of predetermined patterns of air openings formed in an upper sheet, similar to the layered arrangements of FIGS. 8 through 12 discussed above. By supplying air to a single bladder encompassing pad 232, and by using different patterns of openings on either side of imaginary line 238, the two respective zones 234 and 236 may be formed.

For example, the same number of air openings in the form of air holes may be provided in each of the respective subzones. Since subzone 236 is about twice as large as 234 in the present example, the air flow rate in the larger subzone 236 is about one-half that of the oxygenated air flow rate in smaller zone 234. Other ratios may be utilized. Those of ordinary skill in the art will understand that the difference in the air flow ratios of the two zones varies inversely proportional to the change in the ratio of the two sizes. In other words, as one subzone gets larger relative to the other subzone, the air flow rate in such larger subzone goes down at a rate inversely proportional to that of the other subzone.

Advantageously, one pump is utilized and its output split, and again the benefits of air distribution are obtained without causing a cooling effect on the infant. In the example discussed herein, one preferred exemplary oxygenated air flow rate for the upper zone 234 is 1.5 milliliters per minute per square inch of such zone, while the lower zone 236 has an air flow rate of about one-half that, i.e., 0.75 milliliters per minute per square inch.

It will be understood in accordance with the broader aspects of the invention that subzone relative spacing and/or relative flow rates may be varied from the examples above. For example, subzone 234 may be made the same size as subzone 236, but with an arrangement of air openings which still has an air flow rate for subzone 234 twice that of subzone 236.

In the illustrated embodiment of FIG. 13 (including the further description thereof set forth above), the bladder is constructed from a "sandwich" of opposing vinyl elements with a reticulated foam core of approximately 20 to 30 pores per inch used to assure uniform distribution of air inside the bladder. Such a pore size helps assure that flow is not restricted by the pressure from the infant sealing off one side of the bladder to the other.

As in the above example of FIG. 12, an additional layer of reticulated foam may be provided above the bladder for air distribution. Hence, the air dispensed by the bladder flows equally into the area immediately below the pad surface. In such an arrangement, it is not necessarily advantageous to make use of a nonwoven fiber, since the air may follow the fibers and be directed more to the edges of the pad 232, instead of flowing upwardly (i.e., vertically) through the pad. In other words, it is preferred in such an arrangement, in order to have desired flow more directly to the support surface on which the infant resides, to make use of a material which does not divert the low pressure air away from the area of need. A cotton or cotton polyester cover has little resistance to flow and does not interfere with air supply to the infant in the above arrangement, while also serving as a good vehicle for carrying the visual indication means 240 discussed above.

Those of ordinary skill in the art will appreciate various features in common between the embodiments of FIGS. 8 through 12 and that of FIG. 13, and at the same time, differences between such two embodiments but which still are included within the broader aspects of this invention. Likewise, features from the first seven figures may be variously incorporated into such embodiments, without departing from the spirit and scope of the subject invention. Similarly, the number and exact placement of air passageways through the upper bladder element may be varied so as to incorporate two or more zones in some embodiments. Other visual indication means may be utilized for providing indicia for distinguishing the flow rate subzones. Still further, enriched oxygen and/or treated air (i.e., heated or cooled) may be utilized in conjunction with various embodiments, as well as alterative sources of oxygenated air may be, as referenced above.

Still further, those of ordinary skill in the art may use the above aspects of the subject invention to vary the respective sizes and air flow rate ratios between or among two or more zones in a multi-zone crib safety pad. The thickness of any such pad, as well as the respective thickness of various layers thereof, may be varied in accordance with the subject invention. The number of pores per inch may also vary from one embodiment to another, or between different pieces of reticulated foam utilized in multiple layers of present constructions. Reticulated foam or other air permeable materials may be provided in any resilient sublayer beneath a bladder means, in accordance with the subject invention. So, too, the represented pads (or components thereof) may be incorporated into thicker overall mattress arrangements, as an upper surface thereof, or as a special insert portion, or otherwise.

Figure 14:
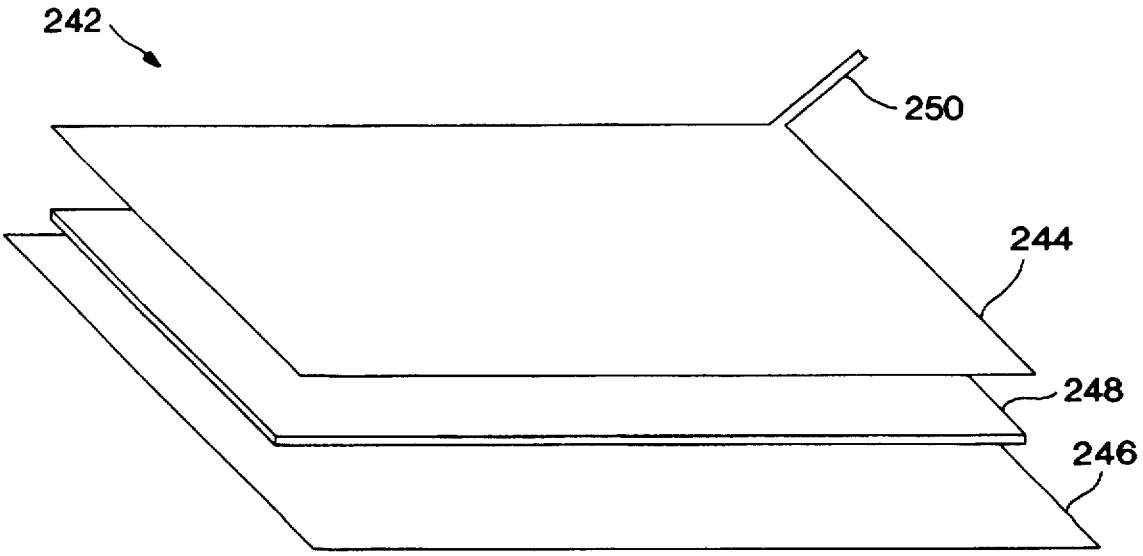
FIG. 14 is an exploded perspective view of features of a present patient care pad embodiment having a low air loss surface in accordance with the present invention for providing cooling and drying effects to a patient received thereon.
Figure 15:
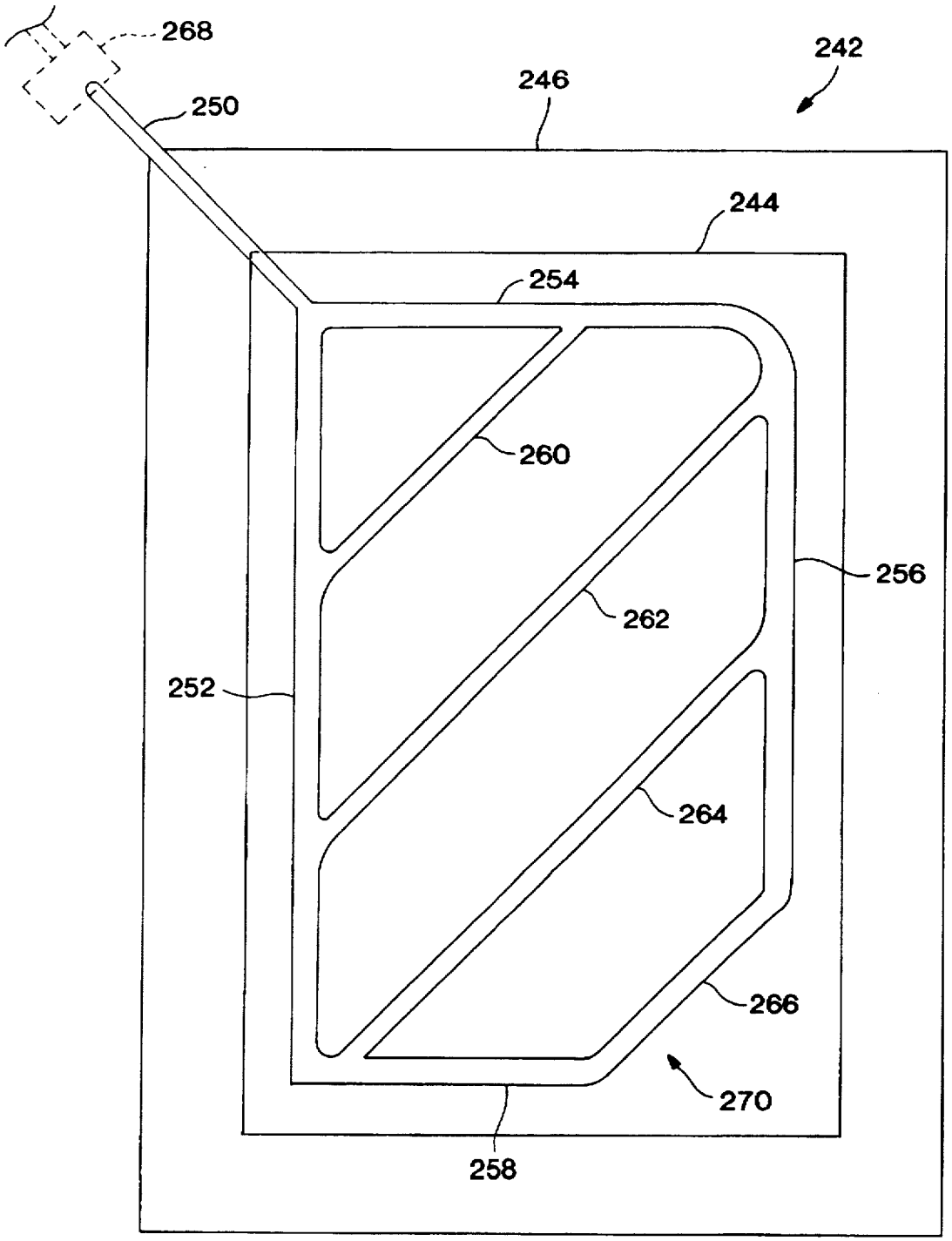
FIG. 15 is a diagrammatical representation of a top elevational view of the patient care pad embodiment of present FIG. 14.

FIGS. 14 and 15 are an exploded, perspective view and diagrammatical top elevational view, respectively, of a patient care pad in accordance with the subject invention, having a low air loss surface for providing cooling and drying effects to a patient received thereon. As discussed hereafter, structural concepts disclosed in accordance with the prior embodiments are particularly adaptable for use with such cooling patient care devices, especially as a single patient use air distribution and ventilation sheet such as using pressurized air from a hospital air supply. Use of even a nominal amount of air from such a supply significantly reduces costs for such a device by eliminating the need for air supply pumps and similar elements, without materially altering the air supply loading of the hospital.

For purposes of illustration, FIG. 14 is not necessarily presented to scale. The purpose of exploded FIG. 14 is to illustrate a perspective view of a patient care low air loss surface generally 242. In such an arrangement, a sheet like bladder is established with upper and lower air impervious mutually sealable sheets 244 and 246, respectively, with a non-blockable layer of air permeable material generally 248 sandwiched therebetween. In one preferred example, the upper and lower sheets are formed of plastic-backed paper, so as to be inexpensively disposable after a single patient use. The air permeable layer 248 may comprise reticulated foam, such as approximately three-eights of an inch thick, and having in a range of from about 30 to about 60 pores per inch.

Though not represented specifically in FIG. 14, it is to be understood that upper sheet 244 is provided with a predetermined pattern of porous air permeable regions, similar (at least in general concept) to the sheet-like bladder arrangement of the embodiments of FIGS. 10 through 13. Broadly speaking, air introduction means, such as represented by air tubing 250, may be associated with such a bladder so as to conduct pressurized air thereto. Such pressurized air then emerges through the upper sheet air permeable regions at a predetermined flow rate. It is generally intended that such flow rate be adequate to provide the desired cooling and drying effects to a patient received thereon. Typically, such flow rates would be above the flow rates referenced above in conjunction with the different focus of SIDS prevention. For such reason, a room-available hospital air supply makes for a desirable source, without having to provide what would be a relatively larger air pump arrangement to achieve the desired air flow rate.

FIG. 15 represents a diagrammatical illustration of a top elevational view of patient care pad 242. Because of the nature of such view, the smaller layer 248 encased between upper and lower sheets 244 and 246 is not seen in the illustration. It will be understood, however, by those of ordinary skill in the art that air tube 250 (in the view of FIG. 15) is above (or on top of) lower sheet 246 and below (or underneath) upper sheet 244, so as to be sealed and sandwiched therebetween, together with such unseen air permeable material layer 248.

As noted, for simplicity in illustration, no porous air permeable regions of upper sheet 244 are represented in FIG. 14. However, the top elevational view of FIG. 15 illustrates in detail exemplary such air permeable regions in accordance with one exemplary embodiment. As shown, such air permeable regions may comprise a network of interconnected air permeable channels, which traverse substantially all regions of the upper sheet 244 for causing cooling and drying effects over the corresponding regions of such patient care pad 242.

As shown, the collective construction of such representative embodiment of channels is primarily rectangular, with perpendicular channels or legs generally 252, 254, 256, and 258. Diagonal legs or channels generally 260, 262, 264, and 266 interconnect the other outer edges of the rectangle. The regions represented are porous and air permeable, so as to pass therethrough oxygenated air otherwise entering the sealed bladder (conjoined elements 244 and 246) via air tube 250. Such regions may be formed by any of various means, such as numerous small perforations in the vicinity of the indicated channels. Other arrangements of predetermined patterns, including arrangements of relatively larger air holes, may be practiced.

Components of one preferred embodiment of such a patient care pad may make use of three "sheets" forming the sheet like bladder, all three of which have differing dimensions. For example, the base or lower sheet 246 in one such example may be about 44 inches by about 32 inches, comprising plastic coated paper. The reticulated foam layer 248 may in such example be about 32 inches by about 20 inches, and about three-eights of an inch thick. Upper sheet 244, with regions of air permeable channels or air passageways, may be about 36 inches by 24 inches.

When provided with air tube 250 (such as a one-quarter inch air tube connection), and appropriately sealed, as referenced above in conjunction with FIGS. 10 through 13, patient care pad 242 provides a low air loss surface usable with an introduced source of pressurized air.

In accordance with the subject invention, air introduction means in some embodiments may comprise other elements beyond air tubing 250 or its equivalents. For example, further components such as a pressure regulator 268 could be practiced. See the dotted line illustration in present FIG. 15 for diagrammatic representation of such a pressure regulator 268, introduced into the air tubing line between patient care pad 242 and an ultimate source of pressurized air (such as the hospital air supply).

Likewise, such element 268 may represent other alterative components which may be combined or practiced with the patient care pad 242, such as oxygen regulation components, air cooling or heating components, or even a simple on/off valve for selectively controlling application of pressurized air without having to disconnect the arrangement from the ultimate pressurized air source. All such variations and further combinations are intended to come within the spirit and scope of the present invention.

Likewise, different sized arrangements of all types may be practiced. In the arrangement illustrated in present FIG. 15, and with the dimensions referenced above, the air permeable regions, generally and collectively referenced by 270, cover about 144 square inches. Other features discussed above in conjunction with other embodiments would then indicate the manner in which desired flow rates may be determined.

In the preferred embodiments herewith, the use of reticulated foam as the air dispenser (or disperser) helps establish a non-blockable airway within a bladder and, when applicable, in an air distribution portion of the pad beneath the infant and above such bladder. The result is a substantially sheet-like product which, in different embodiments, may be used as a SIDS prevention device and as a specific device for cooling and drying the skin of older (i.e., non-infant) patients utilizing essentially the bladder portion alone beneath the patient.

It should be further understood by those of ordinary skill in the art that the foregoing presently preferred embodiments are exemplary only, and that the attendant description thereof is likewise by way of words of example rather than words of limitation, and their use does not preclude inclusion of such modifications, variations, and/or additions to the present invention as would be readily apparent to one of ordinary skill in the art, the scope of the present invention being set forth in the appended claims.

What is claimed is:

1. An infant safety device for the prevention of infant asphyxiation, said safety device comprising:

an infant support pad having an upper support surface formed by a first layer comprised of air permeable material, and a predetermined non-blockable supplemental air dispenser therebeneath, so that a predetermined breathing space is created below an infant received on said upper support surface; and forced air circulation means for circulating oxygenated air through said breathing space via said air dispenser so that carbon dioxide exhaled by an infant received on said upper support surface is flushed from said breathing space so as to prevent asphyxiation of the infant due to carbon dioxide poisoning while oxygenated air for inhaling by such infant is provided to said breathing space so as to prevent asphyxiation of such infant due to oxygen deprivation wherein said air permeable material and said air dispenser comprise respective layers of reticulated foam having in a range of from about 20 to about 100 pores per inch, and said air permeable material and said air dispenser layers each respectively are at least about one-quarter inch thick.

2. An infant safety device as in claim 1, wherein said support pad includes a further layer of relatively softer resiliency, situated beneath said air dispenser layer, and further includes a relatively open weave washable fabric covering about said support pad.

3. An infant safety device as in claim 1, further including below said air dispenser a layer of one of a resilient mass of relatively open weave matter and reticulated foam.

4. An infant safety device as in claim 1, wherein said forced air circulation means comprises an air tube at least partially embedded in said support pad air dispenser, and an air pump operatively interconnected with said air tube and operating for continuously forcing oxygenated air into said air tube.

5. An infant safety device as in claim 4, further including air temperature regulation means associated with said forced air circulation means for controlling the nominal temperature of oxygenated air circulated through said breathing space.

6. An infant safety device as in claim 4 further including oxygen regulation means associated with said forced air circulation means for controlling the amount of oxygen in the oxygenated air circulated through said breathing space.

7. An infant safety device as in claim 4, wherein said air pump is located outside of said support pad air dispenser.

8. An infant safety device as in claim 1, further including a relatively open weave washable fabric covering removably fitted about at least said support pad upper support surface.

9. An infant safety device as in claim 1, wherein said support pad has a thickness generally in a range of from about 0.5 to 2 inches and said air pump operates without contaminating the oxygenated air passed therethrough.

10. An infant safety device as in claim 1, wherein said support pad comprises a mattress having a thickness generally in a range from about 2 to about 8 inches, and said forced air circulation means is operative for circulating oxygenated air from a source outside of said mattress without contamination thereof.

11. An infant safety device as in claim 10, wherein said forced air circulation means includes an air pump located at least partially within said mattress and having access to the source of oxygenated air outside-of said mattress.

12. An infant safety device as in claim 1, wherein said air dispenser comprises a second layer including air permeable material captured in a defined region between upper and lower air impervious sheets, said upper sheet including air passageways defined therethrough and said defined region corresponding with said predetermined breathing space.

13. An infant safety device as in claim 12, wherein said second layer air permeable material comprises reticulated foam, and said upper and lower sheets comprise mutually sealed sheets of material, with a predetermined pattern of air openings formed in said upper sheet.

14. An infant safety device as in claim 13, wherein said predetermined pattern of air openings comprises a network of interconnected channels.

15. An infant safety device as in claim 12, wherein said second layer air permeable material comprises reticulated foam, and said upper and lower sheets comprise mutually sealed sheets of material, with a predetermined number of air holes formed in said upper sheet.

16. An infant safety device as in claim 15, wherein said second layer reticulated foam has in a range of from about 20 to about 40 pores per inch.

17. An infant safety device as in claim 16, wherein said second layer reticulated foam has in a range of from about 40 to about 100 pores per inch.

18. An infant safety device as in claim 16, wherein said second layer reticulated foam has in a range of from about 20 to about 100 pores per inch.

19. An infant safety device as in claim 16, wherein said upper and lower sheets comprise two sheets of vinyl material joined by one of RF welding and heat sealing.

20. An infant safety device as in claim 15, wherein an upper support surface area of said second layer defined region, the placement and number of said air holes, and the flow rate of oxygenated air to said air dispenser are collectively preselected such that placement of an infant's head over said breathing space only partially obstructs the flow of oxygenated air to said breathing space so that at least a predetermined flow rate of oxygenated air thereto is maintained continually without blockage and without causing a cooling effect to the infant.

21. An infant safety device as in claim 20, wherein said second layer defined region is about 4 inches by about 6 inches.

22. An infant safety device as in claim 20, wherein said second layer defined region is about 6 inches by about 6 inches.

23. An infant safety device as in claim 22, wherein said predetermined flow rate is in a range of from about 250 to about 300 milliliters per minute.

24. An infant safety device as in claim 20, wherein said second layer defined region is about 24 inches by about 24 inches.

25. An infant safety device as in claim 24, wherein said predetermined flow rate is in a range of from about 7.0 to about 9.0 liters per minute.

26. An infant safety device as in claim 20, wherein said second layer defined region is divided by said air holes into separate subzones having respective different flow rates of oxygenated air, so that a relatively higher flow rate subzone can be targeted for use with relatively higher risk infants.

27. An infant safety device as in claim 26 wherein said second layer defined region is divided such that one of said subzones is about twice as large as the other subzone, but the number of holes in each respective subzone remain about equal so that the flow rate for the relatively larger subzone is about one-half that of all the relatively smaller subzone.

28. An infant safety device as in claim 27, wherein;

said second layer defined region is about 24 inches by about 24 inches, said relatively larger subzone is about 16 inches by about 24 inches and said relatively smaller subzone is about 8 inches by about 24 inches; and further wherein said flow rate for said relatively larger subzone is about 0.75 milliliters per minute per square inch while said flow rate for said relatively smaller subzone is about 1.5 milliliters per minute per square inch.

29. An infant safety device as in claim 26, further including locator means indicia for differentially indicating the relative locations of the respective separate subzones, so that an infant can be appropriately and selectively placed relative to known controlled flow rates of oxygenated air.

30. An infant safety device as in claim 20, wherein the total flow rate capacity of said forced air-circulation means is determined to be up to about 150 milliliters of air per minute per square inch of said second layer defined region.

31. An infant safety device as in claim 30, wherein said total flow rate capacity is increased in a range of from about 10 percent to about 15 percent higher than the flow rate capacity determined by square inch defined region surface area, so as to offset any flow losses in the support pad first layer.

32. An infant safety device as in claim 20, wherein said predetermined flow rate is at least about 0.9 liters per minute.

33. An infant safety device as in claim 1, further including connector means for directing an external source of pressurized air towards the infant for intentionally causing a cooling effect to the infant.

34. A method of preventing infant asphyxiation during periods of infant bed rest, such as in a crib, said method comprising:

providing a support pad having an upper support surface formed by a first layer comprised of air permeable material, and a predetermined non-blockable supplemental air dispenser therebeneath, so that a predetermined breathing space is created below an infant received on said upper support surface; and circulating oxygenated air through said breathing space via said air dispenser so that carbon dioxide exhaled by an infant received on said upper support surface is flushed from said breathing space so as to prevent asphyxiation of the infant due to carbon dioxide poisoning while oxygenated air for inhaling by such infant is provided to said breathing space so as to prevent asphyxiation of such infant due to oxygen deprivation.

35. A method as in claim 34, further including removably fitting a relatively open weave washable fabric covering about at least said support pad upper support surface.

36. A method as in claim 34, wherein said providing step includes providing said support pad such that said air permeable material and said air dispenser comprise respective layers of reticulated foam having in a range of from about 20 to about 40 pores per inch.

37. A method as in claim 34, wherein said circulating step includes inserting an air tube into a predetermined location inside said support pad air dispenser, and operatively interconnecting an air pump with said air tube and operating such air pump for continuously forcing oxygenated air from around said air pump into said air tube.

38. A method as in claim 37, wherein said breathing space is about 24 inches by about 24 inches, and said method further includes operating said air pump at a relatively constant predetermined air flow rate generating generally at least about 7.0 to about 9.0 liters per minute effective oxygenated air flow to said breathing space.

39. A method as in claim 37, wherein said breathing space is about 6 inches by about 6 inches, and said method further includes operating said air pump at a relatively constant predetermined air flow rate generating generally at least about 250 to about 300 milliliters per minute effective oxygenated air to said breathing space.

40. A method as in claim 34, further including the step of regulating the nominal temperature of oxygenated air circulated through said breathing space so as to have a desired cooling or heating effect on an infant recumbent on said support pad.

41. A method as in claim 34, wherein said pad has a thickness in a range of from about 0.5 to about 2 inches.

42. A method as in claim 34, wherein said pad comprises a mattress having a thickness in a range of from about 2 to 8 inches.

43. A method as in claim 42, wherein said circulating step includes providing an air pump selectively situated one of outside or at least partially inside said mattress, and said air pump having access to a source of oxygenated air located outside of said mattress.

44. A method as in claim 34, wherein said circulating step includes providing selectively enhanced levels of oxygen in said oxygenated air.

45. A method as in claim 34, wherein said circulating step includes circulating oxygenated air through said breathing space without contamination thereof.

46. A method as in claim 34, wherein said providing step further includes providing said support pad such that said air permeable material and said air dispenser layers each respectively are at least about one-quarter inch thick reticulated foam having in a range of from about 20 to about 100 pores per inch.

47. A method as in claim 46, wherein said providing step further includes providing said support pad with a further layer of relatively softer resiliency situated beneath said air dispenser layer, and further includes providing a relatively open weave washable fabric covering about said support pad.

48. A method as in claim 34, wherein said providing step further includes providing said air dispenser as a second layer of said support pad, including air permeable material captured in a defined region between upper and lower air impervious sheets, said upper sheet including air passageways defined therethrough and with said defined region corresponding with said predetermined breathing space.

49. A method as in claim 48, further including providing said second layer air permeable material comprised of reticulated foam, and providing said upper and lower sheets comprised of mutually sealed sheets of material, with a predetermined number of air holes formed in said upper sheet.

50. A method as in claim 49, wherein said providing step includes preselecting an upper support surface area of said second layer defined region, the placement and number of said air holes, and the flow rate of oxygenated air to said air dispenser such that placement of an infant's head over said breathing space only partially obstructs the flow of oxygenated air to said breathing space so that at least a predetermined minimum flow rate of oxygenated air thereto is maintained continuously without blockage and without causing a cooling effect to said infant.

51. A method as in claim 50, wherein said predetermined minimum flow rate of oxygenated air maintained to said breathing space is generally at least about 0.9 liters per minute.

52. A method as in claim 50, wherein said flow rate of oxygenated air is limited to at about no more than twice the tidal volume of the infant, wherein tidal volume is the average volume of air breathed by an infant in one minute.

53. A method as in claim 50, further including the step of dividing said second layer defined region by use of said air holes into separate subzones having respective different flow rates of oxygenated air, so that a relatively higher flow rate subzone can be targeted for use with relatively higher risk infants.

54. A method as in claim 53, wherein said second layer defined region is divided such that one of said subzones is about twice as large as the other subzone, but the number of holes in each respective subzone remain about equal so that the flow rate for the relatively larger subzone is about one-half that of the relatively smaller subzone.

55. A method as in claim 54, wherein:

said second layer defined region is about 24 inches by about 24 inches, said relatively larger subzone is about 16 inches by about 24 inches and said relatively smaller subzone is about 8 inches by about 24 inches; and further wherein said flow rate for said relatively larger subzone is about 0.75 milliliters per minute per square inch while said flow rate for said relatively smaller subzone is about 1.5 milliliters per minute per square inch.

56. A method as in claim 53, further including providing indicia on said support pad for differentially indicating the relative locations of the respective separate subzones, so that an infant can be appropriately and selectively placed relative to known controlled flow rates of oxygenated air.

57. A method as in claim 56, wherein said indicia includes the image of an angel covering both subzones, with the head and halo of such angel located in the subzone having the relatively higher flow rate of oxygenated air.

58. A method as in claim 50, wherein said circulating step includes providing an air pump for continuously forcing oxygenated air from around said air pump into said air dispenser, and wherein the total flow rate capacity of said air pump is determined to be up to about 150 milliliters of air per minute per square inch of said second layer defined region.

59. A method as in claim 58, wherein said total flow rate capacity is increased in a range of from about 10 percent to about 15 percent higher than the flow rate capacity determined by square inch defined region surface area, so as to offset any flow losses in the support pad first layer.

60. A method as in claim 48, wherein said defined region has dimensions falling in a range of about 4 inches by about 6 inches to about 24 inches by about 24 inches.

61. A method as in claim 34, further including the step of regulating the amount of oxygen in the oxygenated air circulated through said breathing space.

62. A method as in claim 34, further including the step of directing an external source of pressurized air towards the infant for intentionally causing a cooling effect to the infant.

63. Crib safety apparatus for the prevention of sudden infant death syndrome due to carbon dioxide poisoning, said apparatus comprising:

a generally rectangular mattress formed by an upper layer of air permeable material so as to be received in a crib, said upper layer defining a generally flat upper support surface for receiving an infant thereon with the infant's head situated adjacent a predetermined target breathing space associated with a selected region of said upper support surface, and said mattress further defining a breathing space non-blockable air dispenser means defining a predetermined volume beneath said selected region, for supplying a flow of air to said breathing space which is effectively not blocked by placement of an infant's head adjacent said predetermined target breathing space;

fabric cover means fitted at least about said mattress upper support surface and comprised of air and liquid permeable material so as to permit the flow of oxygenated air therethrough upwardly towards said target breathing space, and so as to permit the flow of regurgitated fluids and bodily fluids downwardly from the infant towards said mattress upper level; and air pump means for drawing fresh oxygenated air from around the crib surroundings and pumping the fresh oxygenated air into said breathing space via said non-blockable air dispenser means so as to expel carbon dioxide from said breathing space, such that fresh oxygenated air is presented to an infant instead of accumulated exhaled carbon dioxide even whenever the infant is received face down onto said mattress upper support surface target breathing space.

64. Crib safety apparatus as in claim 63, wherein said mattress includes means for indicating the location of said selected region of said upper support surface, so that an infant's head can be selectively positioned adjacent said predetermined target breathing space.

65. Crib safety apparatus as in claim 63, wherein:

said mattress upper layer comprises a layer of reticulated foam generally at least about one-quarter inch thick;

said air dispenser means includes a sublayer of said mattress beneath said upper layer thereof, which sublayer is generally non-crushable under the weight of an infant's head; and said air pump means further includes an interconnecting air tube for directing said fresh oxygenated air into said air dispenser means.

66. Crib safety apparatus as in claim 65, wherein said sublayer is comprised of a sealed vinyl envelope with reticulated foam therein formed as a layer generally at least about one-quarter inch thick, said sealed vinyl envelope including at least one separately sealed pocket forming said air dispenser means predetermined volume, and having one entrance thereto for receiving said air tube, and having a predetermined number and placement of air openings formed in said sealed pocket and facing said mattress upper layer for directing fresh oxygenated air thereto from said air pump means.

67. Crib safety apparatus as in claim 66, wherein said reticulated foam members comprising said mattress upper layer and said sublayer have in a range of from about 20 to about 100 pores per inch.

68. Crib safety apparatus as in claim 67, wherein said range of reticulated foam pores is in a range of from about 20 to about 40 pores per inch.

69. Crib safety apparatus as in claim 66, wherein said air openings comprise a plurality of air holes.

70. Crib safety apparatus as in claim 69, wherein the pumping operations of said air pump means are selectively controlled, the area of said selected region of said upper support surface is selected, and the number and placement of said air holes of said air dispenser means is selected, so that with as many as two-thirds of said air holes obstructed by an infant's head received thereon, generally at least about 0.9 liters of fresh oxygenated air is otherwise delivered per minute into said predetermined target breathing space via remaining unobstructed air holes of said air dispenser means.

71. Crib safety apparatus as in claim 70, wherein the number and placement of said air holes is selected such that said selected region of said upper support surface is divided into respective subzones having selected different air flow rates, so as to establish a subzone of relatively higher air flow rate for use with relatively higher risk infants.

72. Crib safety apparatus as in claim 70, wherein said selected region has a predetermined area falling in a range of from about 4 inches by about 6 inches to about 24 inches by about 24 inches.

73. Crib safety apparatus as in claim 66, wherein said air openings comprise a network of interconnected air channels.

74. Crib safety apparatus as in claim 65, wherein said air pump means is located outside of said mattress.

75. Crib safety apparatus as in claim 63, wherein said mattress has a thickness of between about 0.5 inches to about 2 inches and is adapted to receive a further layer of resilient support thereunder, and wherein said air pump means is operative for pumping fresh oxygenated air without contamination thereof.

76. Crib safety apparatus as in claim 63, wherein said mattress includes an additional resilient support layer beneath said air dispenser means thereof, and has a cumulative mattress thickness of between about 2 inches to about 8 inches, and wherein said air pump means is operative for pumping fresh oxygenated air without contamination thereof.

77. Crib safety apparatus as in claim 63, wherein said mattress air permeable material comprises washable reticulated foam, and said fabric cover means is comprised of washable material removably fitted about said mattress upper support surface and mattress surfaces adjacent thereto.

78. Crib safety apparatus as in claim 63, further including oxygen regulation means associated with said air pump means for controlling the amount of oxygen in the air presented to an infant.

79. Crib safety apparatus as in claim 63, wherein said air pump means is situated at least partially within said mattress.

80. Crib safety apparatus as in claim 63, wherein said air pump means has a flow rate capacity limit of not more than about twice the tidal volume of the infant.

81. Crib safety apparatus as in claim 80, further including connector means for interconnection with an external source of pressurized air for intentionally controllably directing to the infant a flow of air greater than twice the infant tidal volume, for desired infant cooling effect.

82. A two-zone crib safety pad for the prevention of sudden infant death syndrome due to carbon dioxide poisoning, said crib safety pad comprising:

an upper support layer comprised of air permeable material;

two-zone bladder dispenser means, situated below said upper support layer and operative with oxygenated air supplied thereto, for differentially dispensing oxygenated air to two separate zones defined thereby and characterized by respective relatively higher and lower oxygenated air flow rates, which differentiated flow rate zones are extended to an infant received on said upper support layer by the air permeability of such layer; and forced air circulation means for circulating oxygenated air via said dispenser means to an infant received on said upper support layer such that a relatively higher risk infant may be placed in the vicinity of the portion of such layer associated with the relatively higher oxygenated air flow rate zone as determined by said dispenser means.

83. A two-zone crib safety pad as in claim 82, wherein:

said upper support layer air permeable material comprises reticulated foam; and said two-zone bladder dispenser means includes a layer of reticulated foam sandwiched between upper and lower mutually sealed sheets of air impermeable material, said upper sheet having a predetermined pattern of air openings defined therein and respectively situated in at least two respective zones, with the collective flow rate capacity of such air openings being greater in one zone than the other so as to define said differentiated flow rate zones.

84. A two-zone crib safety pad as in claim 83, wherein said reticulated foam of said upper support layer and said dispenser means has in a range of from about 20 to about 100 pores per inch.

85. A two-zone crib safety pad as in claim 83, wherein said reticulated foam of said upper support layer and said dispenser means has in a range of from about 40 to about 100 pores per inch.

86. A two-zone crib safety pad as in claim 83, wherein said reticulated foam has of said upper support layer and said dispenser means in a range of from about 20 to about 30 pores per inch.

87. A two-zone crib safety pad as in claim 83, wherein the relative size and placement of said dispenser means air openings and the flow rate of said forced air circulation means are preselected such that the oxygenated air flow rate of the relatively higher flow rate zone is about twice such flow rate for the relatively lower flow rate zone.

88. A two-zone crib safety pad as in claim 87, wherein the relatively higher flow rate is about 1.5 milliliters per minute per square inch in such respective higher rate zone, and the relatively lower flow rate is about 0.75 milliliters per minute per square inch in such respective lower rate zone.

89. A two-zone crib safety pad as in claim 83, wherein said air openings comprise a matching predetermined number of air holes in each of said respective zones, with one of said zones being larger than the other such that the flow rate of the larger zone relative to that of the smaller zone is inversely proportional to the relative size ratio of the larger zone to the smaller zone.

90. A two-zone crib safety pad as in claim 89, wherein said larger zone is about twice the size of said smaller zone and has a flow rate about one-half that of such smaller zone.

91. A two-zone crib safety pad as in claim 90, wherein said dispenser means is about 24 inches by about 24 inches, said larger zone is about 16 inches by about 24 inches, and said smaller zone is about 8 inches by about 24 inches.

92. A two-zone crib safety pad as in claim 91, further including visual indicator means for indicating on infant receiving portions of said upper support layer the portions thereof corresponding with said larger and smaller zones, so that the nose and mouth of a relatively higher risk infant can be selectively placed in said smaller zone so as to receive the relatively higher oxygenated air flow rate.

93. A two-zone crib safety pad as in claim 83, wherein:

said forced air circulation means provides a flow of oxygenated air to said dispenser means at a single predetermined flow rate; and said dispenser means air openings includes respective different numbers of generally same sized air holes in the respective zones so that the air flow rates from such zones differ correspondingly, with the difference in flow rates corresponding directly with the difference in the numbers of air holes.

94. A two-zone crib safety pad as in claim 82, wherein the flow rate of oxygenated air to an infant received on said upper support layer has a predetermined limit so as to not cause a cooling effect on such infant.

95. A two-zone crib safety pad as in claim 94, wherein said predetermined limit is about twice the tidal volume of the infant, wherein tidal volume is the average volume of air breathed by an infant in one minute.

96. A two-zone crib safety pad as in claim 82, further including a protective covering around said crib safety pad, comprising a generally air and liquid permeable material.

97. A two-zone crib safety pad as in claim 96, further including visual indicator means associated with said protective covering, for indicating the relative location of the respective zones of said dispenser means.

98. A two-zone crib safety pad as in claim 82, wherein said crib safety pad is about 24 inches by about 24 inches, and wherein one of said dispenser means zones is about twice the size of and has about half the flow rate of the other dispenser means zone.

99. A two-zone crib safety pad as in claim 82, further including oxygen regulation means for controlling the amount of oxygen in the oxygenated air circulated by said forced air circulation means.

100. A patient care pad having a low air loss surface for providing cooling and drying effects to a patient received thereon, said patient care pad comprising:

a sheet like bladder with upper and lower air impervious mutually sealed sheets with a non-blockable layer of air permeable material sandwiched therebetween, said upper sheet having a predetermined pattern of porous air permeable regions defined therein, with said bladder having at least one opening thereto for the introduction of pressurized air to such bladder; and air introduction means associated with said bladder such as to conduct pressurized air thereto, which pressurized air emerges through said upper sheet air permeable regions at a predetermined flow rate adequate to provide cooling and drying effects to a patient received thereon.

101. A patient care pad as in claim 100, wherein said non-blockable layer of air permeable material comprises reticulated foam.

102. A patient care pad as in claim 101, wherein said reticulated foam has in a range of from about 30 to about 60 pores per inch.

103. A patient care pad as in claim 101, wherein said layer of reticulated foam is less than about one inch thick.

104. A patient care pad as in claim 103, wherein said layer of reticulated foam has a thickness in a range of from about one-fourth of an inch to about three-eights of an inch.

105. A patient care pad as in claim 100, wherein said air introduction means comprises air tubing passed between said mutually sealed sheets and interconnectable with a hospital air supply.

106. A patient care pad as in claim 100, wherein said non-blockable layer and said mutually sealed sheets are generally rectangular with said non-blockable layer having smaller dimensions than said mutually sealed sheets so as to be fully enclosed therebetween, such that said non-blockable layer conducts substantially throughout said bladder pressurized air introduced into said bladder.

107. A patient care pad as in claim 106, wherein said non-blockable layer is about 32 inches by about 20 inches, said upper sheet is about 36 inches by about 24 inches, and said lower sheet is about 44 inches by about 32 inches.

108. A patient care pad as in claim 100, wherein said air permeable regions comprise a network of interconnected air permeable channels, traversing substantially all regions of said upper sheet for causing cooling and drying effects over corresponding regions of said patient care pad.

109. A patient care pad as in claim 100, wherein said air impervious sheets comprise plastic coated paper.

* * * * *